US006484456B1

(12) United States Patent
Featherstone et al.

(10) Patent No.: US 6,484,456 B1
(45) Date of Patent: Nov. 26, 2002

(54) TELESCOPING MAST ASSEMBLY

(75) Inventors: Harry Featherstone, Wooster, OH (US); Kevan A. Davis, Wooster, OH (US); Bryan L. Cooper, Medina, OH (US)

(73) Assignee: Featherstone Teamed Industries, Inc., Wooster, OH (US)

( * ) Notice: Subject to any disclaimer, the term of this patent is extended or adjusted under 35 U.S.C. 154(b) by 0 days.

(21) Appl. No.: 09/629,773

(22) Filed: Aug. 1, 2000

Related U.S. Application Data

(63) Continuation-in-part of application No. 09/500,509, filed on Feb. 9, 2000.

(51) Int. Cl.[7] ..... E04H 12/34

(52) U.S. Cl. ..... 52/118; 52/28; 52/110; 52/121; 362/250; 362/385; 362/386; 362/419

(58) Field of Search ..... 52/28, 29, 32, 52/121; 362/468, 485, 493, 528, 549, 219, 220, 383, 385, 386, 419, 427, 430, 431

(56) References Cited

U.S. PATENT DOCUMENTS 143,182 A 9/1873 Pierson
301,019 A 6/1884 Teal (List continued on next page.)

OTHER PUBLICATIONS

Ball Drive Actuator—85151/85152 Motion Systems Corporation—Technical Data.
Ball Drive Actuator—85257/85258 Motion Systems Corporation—Technical Data.
21 st Century Policy Supply—Jan. 1, 2000 PowerCam IV, p. 13: MX 7000, p. 25; Code 360 Light Bar and Code 3, p. 33; Value Pack, p. 40; BP 100 Speaker, p. 41; Unitrol TM4 Toucmaster Siren, p. 42,; The Bream, p. 46; Highlighter By Federal Signal & Motorized Mirror and Deck Lights, p. 47.

*Primary Examiner*—Yvonne M. Horton
(74) *Attorney, Agent, or Firm*—Richard B. O'Planick

(57) ABSTRACT

An extendible mast assembly is disclosed comprising a base member (12); a base mast section (16) pivotally coupled thereto; and an extendible mast section (20) telescopically received within the base mast section (16). A first ball drive actuator (14) is mounted and coupled to pivotally drive the mast sections between a horizontal "down" position and a vertical "up" position, and a second ball drive actuator (18) is mounted within the base mast section to move the extendible mast section in and out of the base mast section. A wiring harness (106, 108) is routed from the base of the unit up through the base mast section and the extendible mast section for powering the ball drive actuators (14, 18) and any electrically powered device mounted to the distal end of the mast. The uppermost extendible mast section (20) is composed of non-conductive material to prevent the conductance of a charge down the mast to the vehicle to which the unit is attached. The passageways of the base and extendible mast sections are enclosed to protect the motor and wiring harnesses from detrimental contact with the elements or surrounding obstructions. In an alternative embodiment, the mast assembly is an integral in-line component of a light bar assembly and supports at a remote end optional equipment such as a radar/laser device; a speaker system; auxiliary lighting; video cameras; and a digital sign. The mast assembly, light bar, and safety and detection devices located at the remote end of the mast assembly are mounted to the rooftop of a vehicle and comprise a security system computer controlled remotely from within the passenger compartment of the vehicle. Elevated atop the mast assembly, the security and detection equipment attains a height advantage which functionally improves their performance and serves to remove such equipment from the dashboard of the vehicle, enhancing passenger safety and comfort thereby.

22 Claims, 18 Drawing Sheets

U.S. PATENT DOCUMENTS

| | | | |
|---|---|---|---|
| 456,382 | A | 7/1891 | McPartland |
| 713,911 | A | 11/1902 | McPartland |
| 722,552 | A | 3/1903 | Anderson |
| 1,035,570 | A | 8/1912 | Marshall |
| 1,183,960 | A | 5/1916 | Bienenstock |
| 1,261,112 | A | 4/1918 | Bielhen |
| 1,271,391 | A | 7/1918 | Trojan |
| 2,616,768 | A | 11/1952 | Stemm |
| 3,296,757 | A | 1/1967 | Goodman |
| 4,337,560 | A | 7/1982 | Slysh |
| 4,413,451 | A | 11/1983 | Featherstone et al. |
| 4,488,209 | A | 12/1984 | Gosswiller |
| 4,566,714 | A | 1/1986 | De Witt et al. |
| 4,594,824 | A | 6/1986 | Ziegler et al. |
| 4,600,980 | A | 7/1986 | Dahlgren |
| 4,772,869 | A | 9/1988 | Grammas et al. |
| 5,066,866 | A | 11/1991 | Hallidy |
| 5,102,375 | A | 4/1992 | Featherstone |
| 5,107,672 | A | 4/1992 | Featherstone |
| 5,139,464 | A | 8/1992 | Lehnert |
| 5,168,679 | A | 12/1992 | Featherstone |
| 5,203,746 | A | 4/1993 | Lehnert |
| 5,572,837 | A | 11/1996 | Featherstone et al. |
| 5,743,635 | A | 4/1998 | Hulse et al. |

TELESCOPING MAST ASSEMBLY

CROSS-REFERENCE TO RELATED APPLICATION

This application is a continuation-in-part of U.S. patent application Ser. No. 09/500,509, filed Feb. 9, 2000.

BACKGROUND OF THE INVENTION

1. Field of the Invention

The present invention relates generally to a telescoping mast assembly useful in sundry applications and, more specifically, to a telescoping mast assembly suitable for mobile field use.

2. The Prior Art

Telescoping masts are well known safety devices useful in law enforcement, industrial, military or commercial applications. Such masts are portable devices which can be readily deployed when needed and readily returned to a storage position when not in use. Typical applications are those in which equipment or devices require elevation in order to optimally accomplish their intended function. It may be desirable, or essential, to elevate floodlights, cameras, antennas, or other surveillance equipment by means of a telescopic mast assembly in order for such devices to function optimally. By way of example, one common application is to mount a telescopic light mast upon the roof of a vehicle for illuminating a wide area surrounding the vehicle. The mast must quickly and reliably deploy when necessary, and retract against the roof of the vehicle when not in use. Law enforcement officials, in particular, have found such devices useful in the field.

Heretofore, telescoping masts have been either pneumatically, hydraulically, or chain driven. Pneumatic drive motors require airtight seals between telescopic mast sections in order to function as intended. However, the environment in which such masts are used makes maintaining an airtight condition between mast sections problematic. Contaminants, or radial ice, deposited between mast sections, or at the junction will stop the mast from descending or cause damage to the mast sections, and can easily destroy the seal required for efficient operation of the pneumatic drive. In the event that the pneumatic integrity of the seal is destroyed, the mast will fall due to gravity with a potential for disastrous consequences.

A further disadvantage to pneumatically powered telescoping masts is that they can only assume one of two positions. Either the masts are fully extended or fully retracted. In many applications, however, because of obstructions or other considerations, it is desirable to, have the telescoping mast sections in a partial state of extension or retraction. A further disadvantage with pneumatic drives is that they are relatively heavy in weight, limiting their suitability for vehicle roof applications. In addition, such drives are expensive to manufacture, assemble, and maintain, which limits their commercial appeal.

Finally, in applications where the unit is used on uneven terrain, pneumatic units cannot work consistently on grades exceeding fifteen degrees and, if the loading at the top is high, even less. The tubes on pneumatic masts on slopes exceeding the limit may bend at the joint, causing air leakage at the junction and a corresponding failure. A unit accordingly is needed which can safely maintain structural integrity on slopes exceeding fifteen degrees.

Hydraulic systems for elevating masts suffer from many of the same shortcomings. Hydraulic drives are relatively heavy in weight and are expensive to manufacture, assemble, and maintain. Moreover, such drives are vulnerable to damage from contact with the environment since hydraulic lines are exposed. Additionally, contaminants can infiltrate the hydraulic system and cause malfunction or failure.

Chain driven telescopic masts likewise suffer from the same deficiencies. The drive mechanisms are relatively heavy in weight and are expensive to manufacture, assemble,, and maintain. The chain link mechanism is also exposed and susceptible to damage from contact with environmental objects.

Other shortcomings common to the aforementioned conventional telescopic mast drives and devices are that the wiring to the outboard end of the mast is exposed and can be damaged by inadvertent contact with surrounding obstacles or suffer from damage from exposure to the elements. Moreover, the masts are generally fabricated from conductive material from the base to the top end. An electrical charge introduced into such masts from inadvertent contact with exposed overhead electrical lines will, accordingly, be transferred to the vehicle below, causing a potential for danger to the operators on the ground. Available systems lack effective means for preventing such a charge transfer, such as a fuse system. However, even were fuses implemented into wiring of available units, because the wiring is exposed to the elements, such fuses would be prone to damage and deterioration from exposure to the elements and may not function as intended when they are needed. A further shortcoming to conventional telescopic mast systems is that their relative large physical size makes mounting such assemblies to vehicle rooftops cumbersome. Since the roofs of contemporary cars and trucks are comparatively small by historical measure, a mast system of a more compact design and configuration than those available currently is needed. Moreover, telescoping masts often must share the roof surface of police or emergency vehicles with other devices such as a horizontal light bar. The presence of a light bar reduces the surface area available for mounting a telescoping light mast assembly. A need, accordingly, exists for a light mast assembly which occupies a relatively small surface area of a rooftop and which is compatible with other devices such as a horizontal light bar on the roof of a vehicle.

Telescoping masts, heretofore, have been employed primarily as a stand alone rooftop units for the purpose of elevating an illumination device to a higher position in order to enlarge the illuminated field. Such light masts are not deployed when the vehicle is in motion because they cannot withstand wind sheer forces generated impinging upon a moving vehicle. Rather, the light masts can only be deployed when the vehicle is stationary. This restriction on the use of telescoping masts is a significant deficiency and prevents the use of telescoping mast-mounted equipment in a myriad of circumstances where such equipment would be useful. There is, according, a need for a telescoping mast system which can be used in mobile circumstances and withstand the wind forces impacting against a moving vehicle.

A further deficiency in state of the art telescopic masts is that they heretofore have only found application in supporting illumination devices. No available vehicle mounted mast systems provide the capability for elevating radar detection devices; video or audio equipment; strobe lighting; digital signage, or other types of safety equipment. There is, accordingly a long felt need for a safety system comprising a telescoping mast capable of supporting and elevating a diverse range of safety equipment, including audio speakers; radar/laser speed detection devices; emergency lighting;

video surveillance equipment; and/or digital warning signage. Such equipment, while operational at a rooftop level, would benefit functionally from placement at a higher elevation. A further need is for a mast system that can support such equipment while the vehicle is in motion. A police vehicle, by way of example, would find it advantageous to elevate, actuate, and operate speed detection, video, audio, or digital warning signage equipment while the vehicle is in motion.

There is a further safety benefit to relocating audio, video, detection, and other types of equipment from the interior of a vehicle to a rooftop location. Heretofore audio, video, and speed detection equipment have been positioned within the passenger compartment of a police or emergency vehicle on the dashboard, seat, or floor, within reach and visual line of sight of the driver. Such a location not only does not place the equipment in an optimal high elevation, but also tends to result in an undesirably cluttered internal compartment of the vehicle proximate to the driver. The clutter created by placing such equipment in close proximity to the driver results not only in discomforte for the driver, but can pose a safety risk by complicating the operation of the vehicle, diverting the driver's attention from the road, and by restricting the drivers line of sight and mobility within the driver's compartment.

Accordingly, there is a need for a safety system that simplifies the interior compartment of emergency or police vehicles. Such a system preferably would eliminate the concentration of equipment within the internal compartment of a police or emergency vehicle, place the equipment at an optimal elevated position on the rooftop of the vehicle, yet do so in a manner which is space efficient and which does not interfere with the operation of other devices on the roof such as a horizontal light bar.

SUMMARY OF THE INVENTION

The present invention overcomes the aforementioned deficiencies in available telescoping mast systems by providing a ball actuator drive system. A telescoping extendible mast section is housed within a base mast section which mounts to a base plate. A first ball actuator mounts to the base plate and drives the base mast section between a horizontal storage position and a vertical work position. The base plate ball actuator comprises an electrically powered motor, which drives a ball screw along a stroke path. A remote end of the ball screw is attached to a bottom end of the base mast section and pivots the base mast into alternative angle of elevation by pushing and pulling against the bottom end of the base mast section. The base mast section can, accordingly, be placed and held in any angle required between the storage and work positions.

The telescoping extendible mast section is likewise driven between an extended position and a retracted position by a second ball actuator drive system. The second drive system is fixedly mounted within the base mast section and comprises a drive screw affixed at a remote end to the extendible mast section. Movement of the drive screw along a stroke path pushes and pulls the extendible mast section into alternative positions between the extended and retracted positions. The extendible mast section can, as with the base mast section, be placed and maintained in any of the alternative positions to conform to the physical constraints of the space in which the mast is used. The extension of the extendible mast section is independent of the elevational operation of the base mast section, affording the user a wide range of options for optimally positioning the telescoping mast. Positive actuation of the mast sections in both directions by the drive motors will operate effectively on slopes of twenty degrees or more.

Additional stages or telescoping mast sections may be employed in order to increase the maximum reach or the mast. A ball drive actuator for each such additional section can be likewise utilized. The mast sections and ball drive actuators are relatively lightweight and are readily assembled and maintained. In addition, the wiring which supplies power and control signals to the ball drive actuators and to electrical devices mounted to a remote end of the mast assembly is housed entirely within the axial passageway of the coaxial mast sections. Protected from exposure to the elements, or damage from contact with surrounding objects, degradation or damage to the wiring is avoided. The top section of the mast is composed of non-electrically conductive material in a preferred embodiment. Such a composition prevents that section from transferring an electrical charge to the vehicle to which the mast assembly is mounted. Danger to operators below from inadvertent contact between the remote section of the mast and exposed overhead conductors is, thereby, avoided. Further, inasmuch as the wiring to the top of the mast is protected within the mast sections from the elements and from damaging contact with environmental obstructions, an effective and reliable fuse system can be incorporated into the wiring harness which will stop the transfer of electrical current form the wires into the base of the unit and therefrom into the vehicle frame. According to another aspect of the invention, the telescoping extendible mast assembly summarized above is integrally incorporated into a horizontal light bar positioned across a police or emergency vehicle rooftop. The mast assembly is positioned in line with the light bar and shares electrical and control conduits within the light bar assembly. So positioned, the mast assembly lies flat upon the roof of the vehicle in the down position and can be rotated into a vertical position if needed. Optional equipment such as a radar speed detector, a speaker assembly, lighting devices, digital warning sign, and/or video cameras can be collectively or alternatively mounted to the remote end of the mast assembly and thereby elevated to an optimal elevation above the roof surface. The mast assembly is configured to withstand sheer forces resulting from vehicle movement. Accordingly, the mast can be extended while the vehicle is in motion and the equipment carried thereby maintained in an advantageous elevated position. The telescoping mast and the equipment supported thereby are preferably computer controlled by a computer located within the vehicle passenger compartment within visual and manual reach of the driver. Redeployment of safety and detection equipment from the interior passenger compartment of the vehicle to the rooftop reduces clutter surrounding the driver and passengers for the enhanced comfort and safety of such individuals.

Accordingly, it is an objective of the present invention to provide a telescoping mast assembly having an improved drive system for motivation a plurality of mast sections between storage and work positions, and into alternative positions therebetween.

A further objective of the invention is to provide a telescoping mast system having means for encasing and protecting wiring which is routed from the base to the remote end of the mast.

Yet a further objective is to provide a telescoping mast system having a positive drive mechanism associated with each mast section, which independently pushes and pulls its respective mast section between and up and a down position, and into alternative positions therebetween.

Another objective is to provide a telescoping mast system having improved means for electrically isolating the underlying vehicle on which the mast system is mounted.

Still a further objective is to provide a telescoping mast system which is relatively lightweight and protected from deterioration due to exposure to the elements.

A further objective is to provide a telescoping mast system comprised of relatively inexpensive components which are economically and readily assembled and easily maintained. A further objective is to provide a telescoping mast assembly for a horizontal light bar assembly.

A further objective is to provide a horizontal light bar assembly for rooftop vehicle use having a telescoping mast assembly incorporated therein.

A further objective is to provide a security and monitoring system for rooftop vehicle use and controlled from within the vehicle passenger compartment.

A further objective is to provide a security and monitoring system for rooftop vehicle use providing for integrated horizontal light bar and telescoping mast components.

A further objective is to provide a security and monitoring system for rooftop vehicle use providing for a telescoping mast capable of operation in the extended position during vehicular movement.

A further objective is to provide a security and monitoring system for rooftop vehicle application providing for selective elevation of security and monitoring components above the vehicle roof in stationary and mobile situations.

A further objective is to provide a method of integrating lighting and telescopic mast supported equipment upon the rooftop of an emergency vehicle.

A further objective is to provide a method of converting existing horizontal light bars to integrate with telescopic mast supported devices upon the rooftop of an emergency vehicle.

A further objective is to provide a method of integrating myriad safety devices of an emergency vehicle.

These and other objectives, which will be apparent to those skilled in the arts, are achieved by a preferred embodiment which is described in detail below and which is illustrated by the accompanying drawings.

DESCRIPTION OF THE PREFERRED EMBODIMENT

Figure 1:
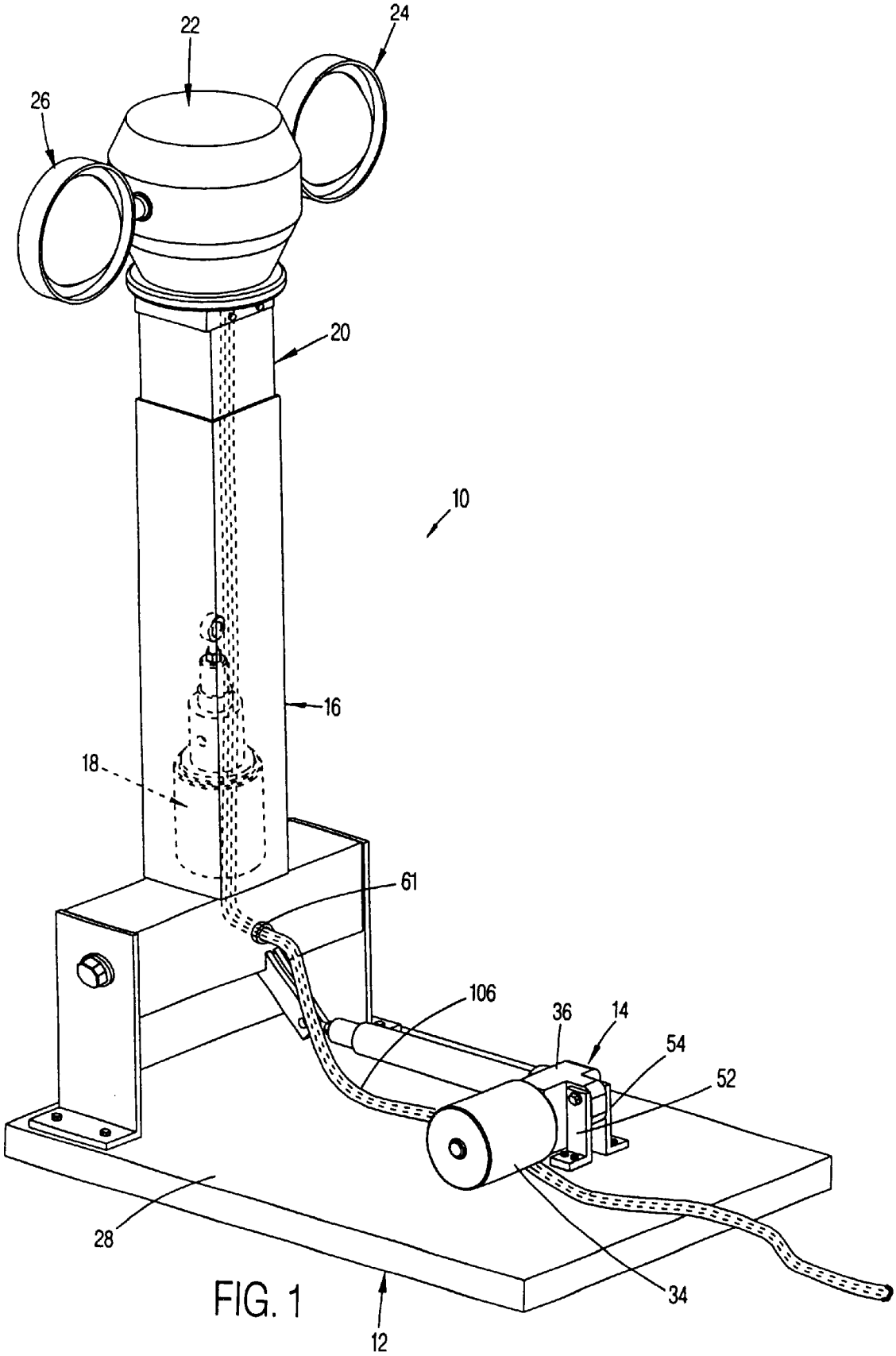
FIG. 1 is a right front perspective view of the subject telescoping mast system shown in the raised position.
Figure 2:
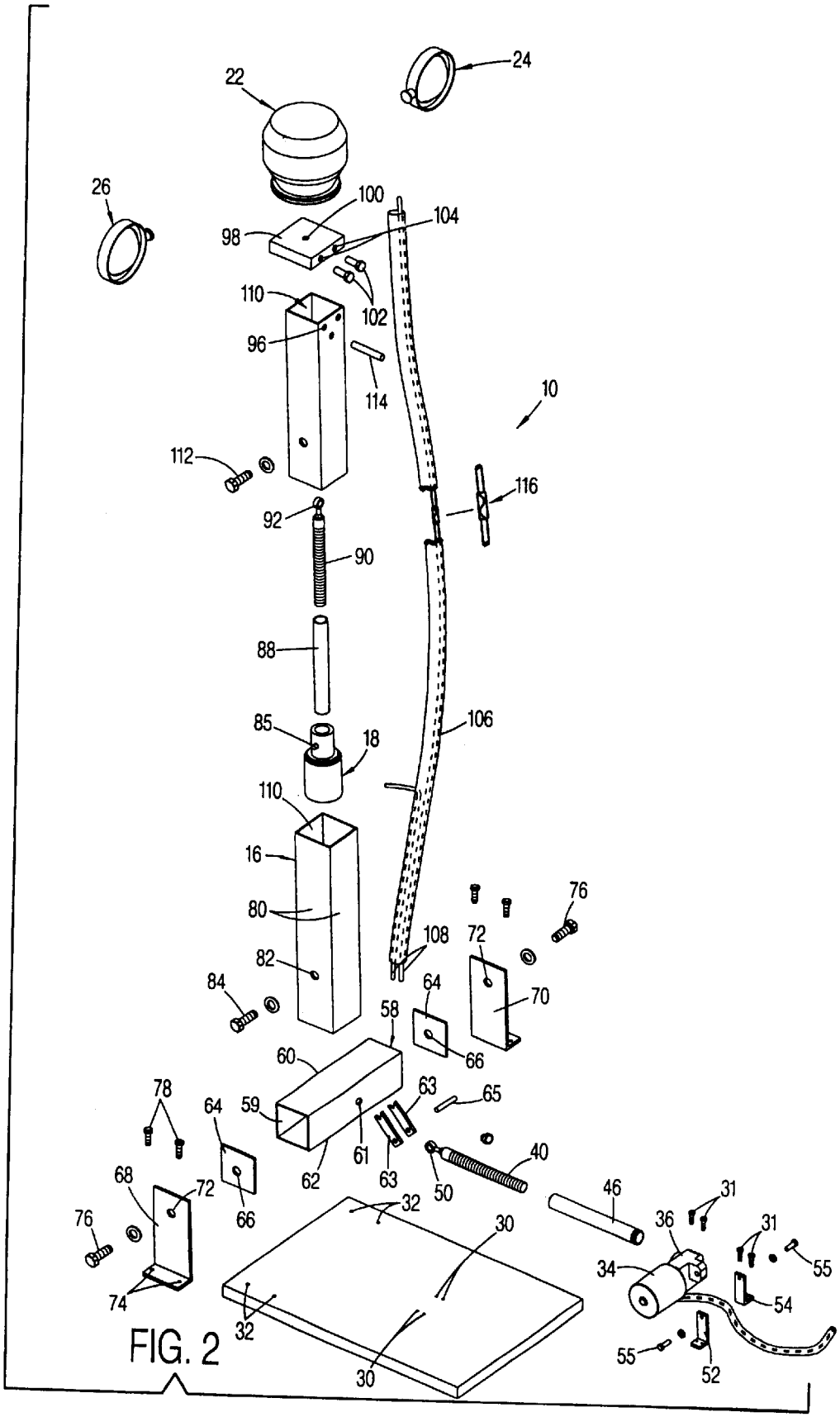
FIG. 2 is an exploded perspective view thereof.

Referring first to FIGS. 1 and 2, the subject telescoping mast assembly 10 is shown comprising, generally, a base mounting plate 12; a first drive motor 14; a base mast section 16; a second drive motor 18; an extendible mast section 20; a motorized light assembly 22; and two lamps 24, 26. The base plate is fabricated from steel or other suitably strong material and includes an upper surface 28, four rearward mounting apertures 30, and four forward mounting apertures 32.

The base plate 12 is intended to further include means (not shown) for attachment to a vehicle surface, most commonly a roof. Means for attachment is conventionally by welding.

Figure 5:
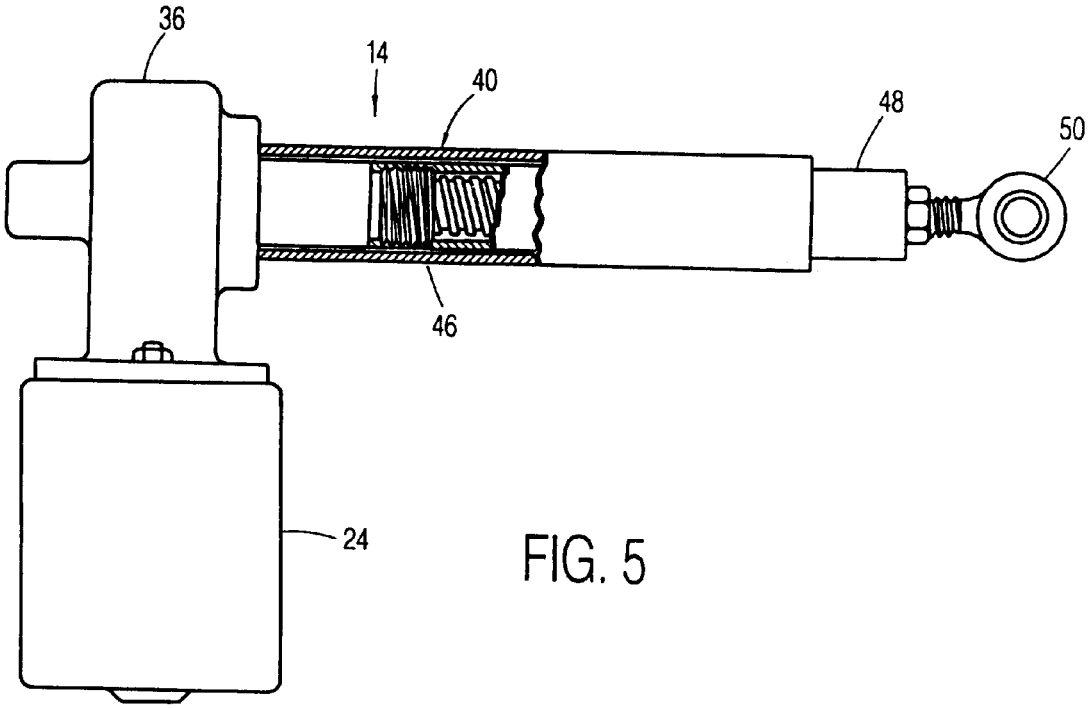
FIG. 5 is a side elevational view, partially in section, of the ball drive actuator for the base mast section.
Figure 6:
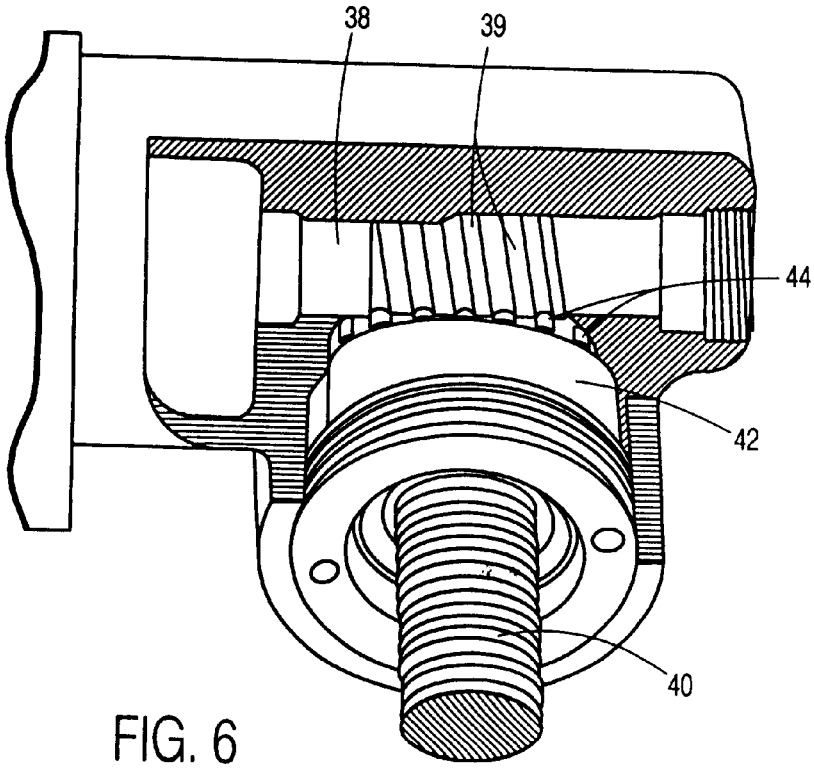
FIG. 6 is an enlarged perspective view of ball drive portion of the ball drive actuator for the base mast section.

Continuing, with reference to FIGS. 5 and 6, the first drive motor 14 is preferably a ball actuator of a type available in the industry. By way of example, without intending to limit the scope of the invention, a suitable ball actuator is manufactured and sold by Motion Systems Corporation located at 600 Industrial Way West, Eatontown, N.J. 07724 under part number 85152. The ball actuator comprises a motor housing 24 and a gear box housing 36, a worm shaft 38 having threads 39, and a ball drive screw 40. The screw 40 includes a geared epicyclic ball 42 at an inboard end across which gear teeth 44 are spaced. A tubular cover 46 encases the ball drive screw 40 forward to a ball screw forward end 48. Extending forward from the end 48 is an attachment eyelet 50.

Figure 3:
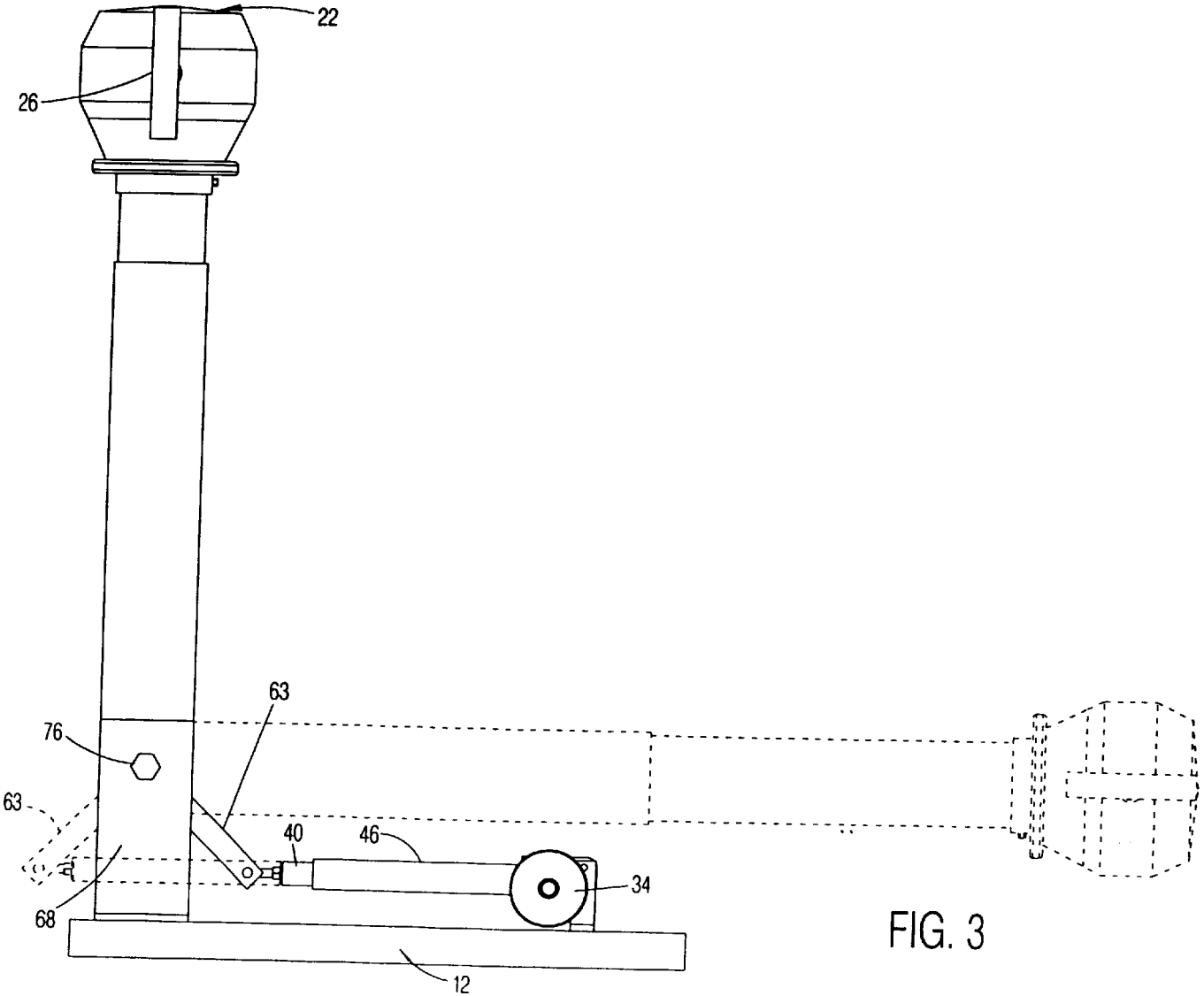
FIG. 3 is a side elevational view thereof.
Figure 4:
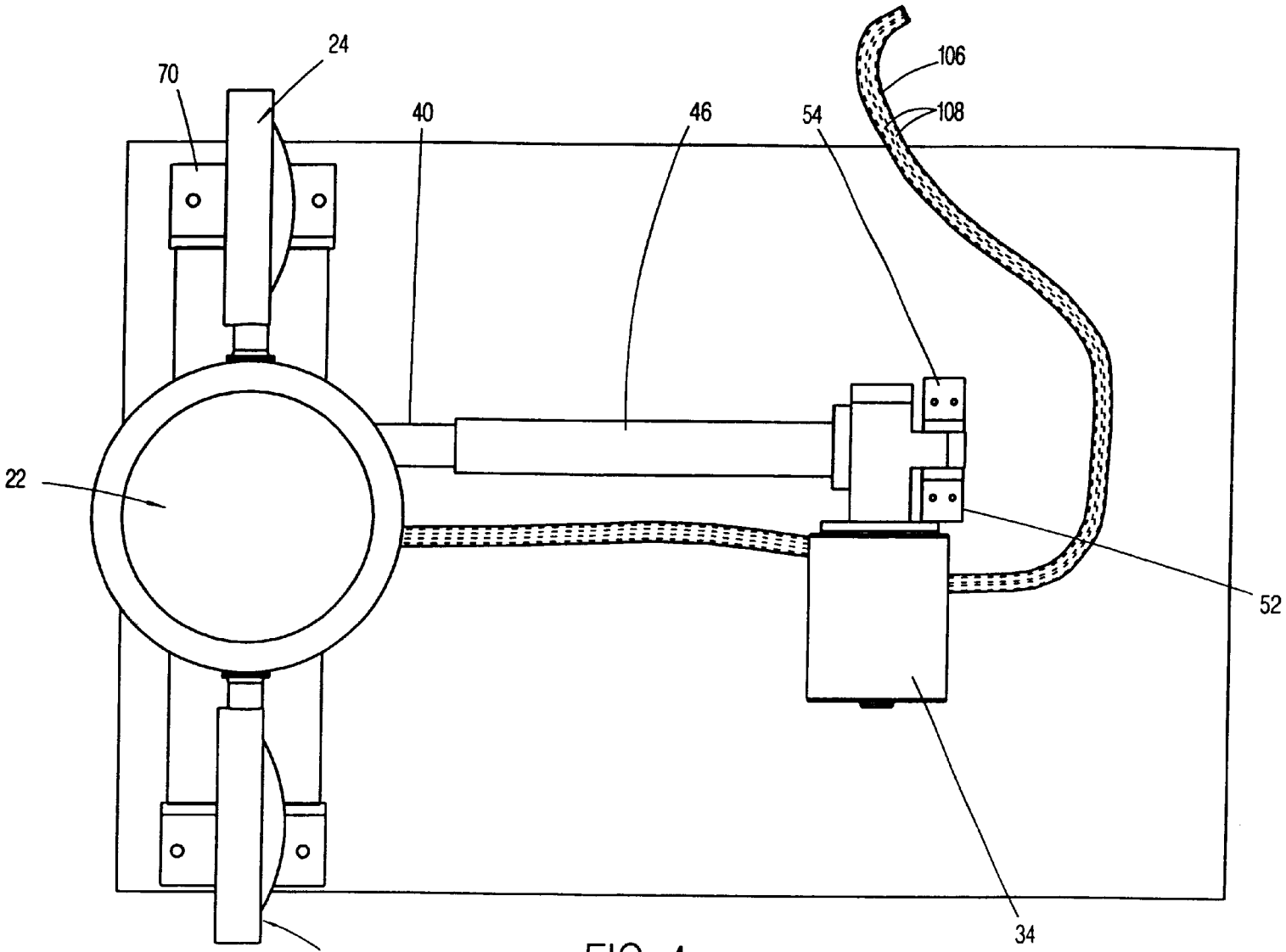
FIG. 4 is a top plan view thereof.

The stroke of the screw 40 is selected to correspond with the pivoting of the base mast section between a horizontal, "down", position and a vertical "up" position as shown in FIG. 3. The loading of the Model 85152 motor of the preferred embodiment is recommended at five hundred pounds or less. The basic construction of the ball actuator 14 incorporates a high efficiency 0.653 inch diameter epicyclic ball screw 40 with integral freewheeling at stroke ends to eliminate the need for limit switches.

The actuator 14 transmits thrust with the epicyclic ball screw 40. Stop pins are provided (not shown) at each end of travel to initiate freewheel and linear advancement stops at those points. The epicyclic ball screw 40 thus moves along a reciprocal linear path to push and pull against the base mast section as will be explained below.

Motor speed reduction to drive the ball drive 49 is by means of a single stage worm gear reducer. The worm shaft 38 runs in a bearing at the motor end and a ball bearing at the opposite end and drives the ball screw 40. Both the worm and gear are fabricated from heat treated steel and are sealed and permanently lubricated. The reduction ratio utilized is preferably 10:1 but other ratios can be utilized to vary the stroke speed.

The motor 24 is electrically powered in the preferred embodiment. For vehicle usage, the motor 24 can be 12VDC; however, for other applications an AC configuration is available. The stroke length of the ball screw 40 is preferably eight and one-half inches; however other stroke lengths may be designed into the telescoping mast assembly within the teachings of the invention.

The cover 46 is fabricated from aluminum with a ring seal at its outboard end in order to protect the screw 40. The ball screw end 50 is self-aligning and a weatherproof motor enclosure is provided to protect the motor from the elements.

With reference to FIGS. 1 and 2, the gear box 36 is mounted to the base plate 12 top surface 28 by means of L-shaped brackets 52, 54 which attach through apertures 30 of the plate 12 by means of screw 31, and into the motor housing 36 by screws 55. A base mast support arm 58 is provided, formed of steel stock and having a square cross sectional axial passageway 59 therethrough. The support arm 58 comprises an upper surface 60, a centrally disposed aperture 61 extending through a rearward facing side, and a lower rearward facing edge 62. A pair of spaced apart steel pivot arms 63 are affixed to the lower edge 62 of support arm 58, by a welded joint or other suitable means, and depend downward therefrom at a substantially 45 degree angle. A pair of end covers 64 are also provided for attachment to the opposite ends of arm 58 and each cover 64 is provided with a centrally disposed through aperture 66. A connector pin 65 is further provided to affix the end 50 of ball screw 40 to the arms 63 as shown.

A pair of mounting L-shaped brackets 68, 70 are included in the assembly, each having a central aperture 72 in an upstanding portion and a pair of apertures 74 in a horizontal portion. The brackets 68, 70 are preferably fabricated of stainless steel stock and affix to outward sides of the covers 64. Aperture 72 of the brackets 68, 70 align with a respective aperture 66 of the covers 68, 70 and pivot pins 76 are provided to project through the coaligned apertures, whereby pivotally joining the support arm 58 to brackets 68, 70. Screws 78 project through the apertures 74 and into apertures 32 of the base plate 12 to secure the brackets 68, 70 to the base plate. The arms 63 are affixed, preferably by welding, to the lower front edge 62 of the support arm 58 and provide the means through which member 58, pivotally suspended between brackets 68, 70 above support plate 12, is pivotally actuated according to the teachings of the invention.

The base mast section 16 is a square, four sided enlongate arm, having four sides 40, a pair of through apertures 82 (one of which shown in FIG. 2), and a central, axial through passage 110. The base mast passage 110 is intended to receive and support therein the second drive motor 18 shown in FIG. 2 and in greater detail in FIG. 7.

Figure 7:
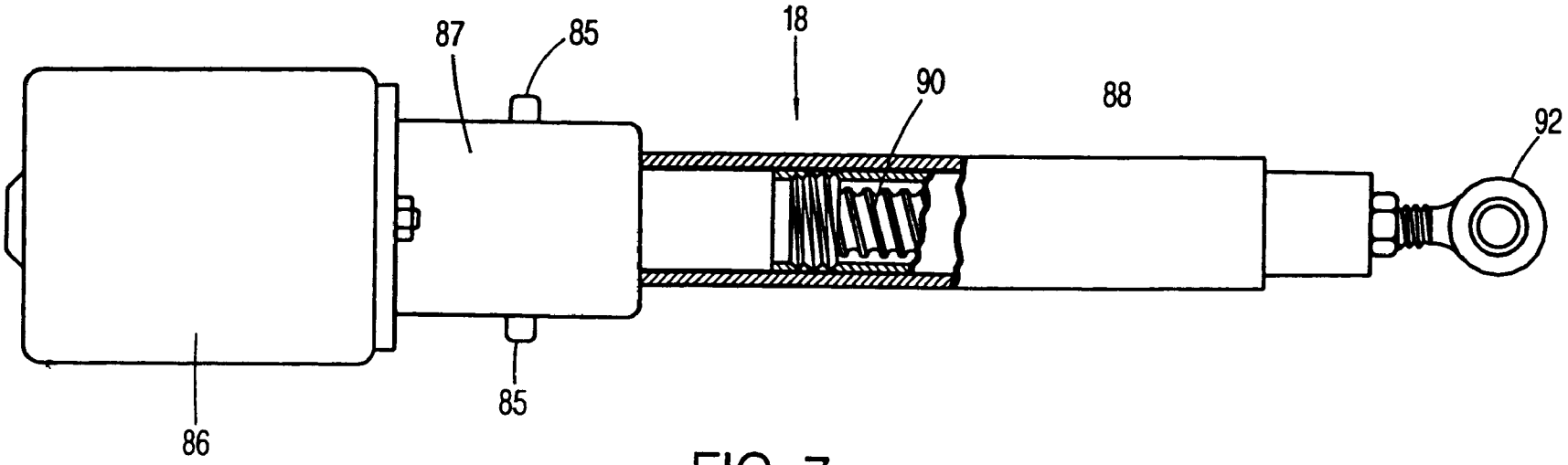
FIG. 7 is a side elevational view, shown partially in section, of the ball drive actuator for the extendible mast section.

Referring to FIG. 7, the second drive motor 18 is an in line ball drive actuator, of a type available in the industry. By way of example, without intending to limit the scope of the invention, a suitable ball actuator is manufactured and sold by Motion Systems Corporation located at 600 Industrial Way West, Eatontown, N.J. 07724 under part number 85258. The ball actuator comprises a motor housing 86 and a gear box housing 87, a pair of outwardly extending lugs 85, and a ball drive screw 90. The screw 90 includes a geared epicyclic ball (not shown) at an inboard end across which gear teeth are spaced. A tubular cover 88 encases the ball drive screw 90 forward to a forward rod end eyelet 92.

The stroke of the screw 90 is selected to correspond with the requisite distance between full "in" and full "out" positions of mast section 29, as will be appreciated from FIGS. 1 and 3. The stroke length in the subject application is selected as thirty-two inches, however, an alternative stroke length may be utilized if desired. The ball drive actuator 18 is designed to provide high stroke speeds under relatively low loading as compared with the first ball actuator 14 described previously. The unit provides for direct coupling of the ball screw 90 to a motor (not shown) encased within housing 86. The basic construction of the ball actuator 90 incorporates a high efficiency .653 inch diameter epicyclic ball screw with integral freewheeling at stroke ends to eliminate the need for limit switches.

The actuator 18 transmits thrust with the epicyclic ball screw 90. Stop pins are provided (not shown) at each end of travel to initiate freewheel and linear advancement stops at those points. The epicyclic ball screw 90 thus moves along a reciprocal linear path to push and pull against the telescopic mast section 29 as will be explained below.

A standard 1:1 gear ratio is preferred in the ball drive actuator. The motor of actuator 18 is electrically powered in the preferred embodiment. For vehicle usage, the motor can be 12VDC; however for other applications an AC configuration may be preferable at the option of the user.

The cover 88 is fabricated from aluminum with a ring seal at its outboard end in order to protect the screw 90. The rod end 92 is self-aligning and a weatherproof motor enclosure is provided to protect the motor from the elements.

The housing 87 is provided with external diametrically opposite lugs 85 used in mounting the motor 18 within the base mast section 16 as explained below.

Enclosing a top of the extendible mast section 20 is a cover plate 98 having a central through aperture 100. The plate 98 further has a pair of spaced apart sockets 104 in each of two opposite sides, providing attachments in affixing the plate to the mast section 20 by four screws 102. The over 98 fits over the top of the mast section 20 and provides a mounting surface for the lamp assembly 22.

Mounted to the support plate 98 is a pivoting lamp fixture 22 and a pair of diametrically opposite lamps 24, 26. The assembly comprising fixture 22, 24, 26 is commercially available. For ample Havis Shields Corporation, located 395 Jacksonville Road, Warminster, Pa. 18974, manufactures and sells such devices as Model KR-31-37 light-heads. The Havis Shields units are available in both DC or AC versions. The assembly fixture pivots 360 degrees. The lamps 24, 26 are rotatably connected to fixture 22 and can rotate ninety degrees upward and forty degrees downward from the horizontal. The lamp assembly is powered by an electric motor housed within fixture 22. While the assembly shown in the preferred embodiment is a lighting device, the subject invention is not intended to be so limited. Other applications will be apparent for the use of the telescoping mast assembly comprising the invention. By way of example, photographic, communication or testing devices can be mounted to the upper end of the extendible mast 20 if so desired.

As best shown in FIGS. 1 and 2, a wiring harness 106 comprising a bundle of conductors 108 supplies electrical power and control signals to the motors 14, 18, and to the lamp assembly 22. The ball drive actuator 18 is mounted within a central passageway 110 of the base mast section 16 as lug projections 96 project through the apertures 82 and are fixedly retained by screws 84. The extendible mast section 20 is telescopically received within the passageway 110 and an axial passageway 116 of section 20 is in coaxial alignment with the passageway 110. The ball screw 90 projects upward into passageway 116 and is secured to extendible mast section 20 by a pin member 114 positioned through the ball screw eyelet 92 and an upper end portion of the mast section 20. The stroke of ball screw 90 is selected such that the extendible mast section 20 will not escape the base mast section with the screw 90 in its full out position.

The first drive motor 14 is mounted fixedly to the base plate 12 as described above. So positioned, the ball screw 40 projects forward and is attached between the arms 63 of the base section support 58 by means of pin 65. The motor 14 acts in reciprocal fashion to push the base mast section into a "down", horizontal position when ball screw 40 is fully extended, and pull the base mast section 16 into an "up", vertical, position when ball screw 40 is fully retracted. The ball screw 40 is positioned relative to the base mast section 16 so as to place the section 16 in the "up" and "down" positions at the opposite limits of the ball screw stroke. FIG. 3 illustrates movement of the base mast assembly between the "up" and "down" positions.

The operation of the ball drive actuator 14 is such that the base mast section 16 can be pushed or pulled to any position between the "up" and "down" positions and held in place. This affords the user maximum flexibility in avoiding obstructions and placing the lamp assembly in its optimal location. The base mast section 16 pivots the support 588 and its position is positively controlled by the operator through electrical control of ball drive actuator 14. Once positioned, the base mast section 16 remains in place until further movement is initiated by the ball drive actuator under control of the user.

Similarly, the operation of ball drive actuator 18 is such that the extendible mast section 20 can be pushed or pulled to any position between the fully extended, "out", position and the fully retracted, "in", position. This gives the user further control over positionment of the lamp assembly and allows the placement of the lamp assembly in an optimum location. Operation of motor 18 is independent of operation of motor 14 and electrical control signals can selectively transmit to either or both motors 14, 18 to precisely place the mast section 20 or the base mast section 16 in its optimal position. Other pneumatic or hydraulic systems, which only function with the mast sections in either a fully retracted or fully extended position, limit the range of adjustment and substantially reduce the utility of the unit.

The positive operation of the motors 14, 18 upon respective mast sections 16, 20, supplies direct power to push or pull such masts in both extension and retraction directions. The motors thus can overcome radial ice build up between the telescoping mast sections in both the extension and retraction directions. Should ice build up while the mast sections are extended, the motors 14, 18 can overcome the resistance created thereby. In contrast, pneumatic systems use pneumatic power to extend the mast sections but rely upon gravity for retraction of the mast sections. Radial ice build up or ice at the mast junctions, or other contamination between the mast sections, may present such resistance that gravity will fail to bring the mast sections down.

A further advantage of the direct drive provided by the drive motor 18 is that actuation is along the axis of the extendible mast section. Mechanical advantage is thereby maximized. Moreover, the unit of the subject invention can effectively operate on slopes of twenty degrees or more because flexure at the junction of the mast sections will not impair the operation of motor 18. In contrast, pneumatic units of the prior art which rely upon the maintenance of an air tight seal between mast sections will not work consistently over a fifteen degree slope. As greater slope will cause the tubes or mast sections of pneumatic systems to bend, causing air leaks to occur at the mast section junction and a corresponding failure in the drive system.

It will further be appreciated that the subject telescoping mast assembly is sealed from the elements and, accordingly, will function more dependably than alternative prior art systems. The ball drive actuators are sealed against intrusion of water or contaminants. Secondly, the axial passageways in which the actuators reside are enclosed. The cover plate 98 at the top prevents intrusion of the elements from above. Moreover, the base section support 58, base mast section 16, and extendible mast section 20 are enclosed in the assembled condition, preventing the majority of the elements from reaching the ball drive actuators. Prior art devices, for example hydraulic units, have operative components exposed to the elements and can fail from such exposure.

The subject assembly as described above comprises a relatively small number of component parts which are readily assembled and which can, if necessary, be readily repaired. The ball drive actuators 14, 18 can be easily disconnected from their respective mast sections and removed. Replacement of the actuators is equally convenient and can be accomplished with minimal down time. In contrast, hydraulic, pneumatic, or hybrid systems are complicated, comprise a relatively large number of parts, and are relatively more difficult to assemble and repair. In addition, as explained previously, such alternative systems have components mounted in an exposed manner and such components are frequently damaged from rough handling or dirt contamination. The subject invention protects the drive motors within the shaft sections and avoids contact with external obstructions.

From FIGS. 1 and 2 it will be noted that the wiring cable 106 enters into the passageway 110 of the base mast section 16 via aperture 61 and thence proceeds upward through the wiring harness for the subject telescoping mast assembly is housed within the mast sections from the base of the assembly to any device mounted to the top. The wiring is accordingly protected and will not snag or contact obstructions which are inevitably present in field applications. In contrast, prior art mast assemblies have external wiring which can snag on maintenance tools, or low branches or overhead obstructions. Damage to the wiring may remain undetected until the unit is needed in an emergency situation, creating a hazard to those relying upon the unit to function as intended.

Referring to FIG. 1, it will be appreciated that the uppermost mast section 20 can be formed of steel plating if desired. However, according to the teachings of the invention, it is desirable to form the uppermost section 20 from a non-conductive material such as plastic or fiber glass. In so doing, the transfer of an electrical charge from the device at the top of the mast or from the uppermost mast section down to the vehicle that the unit is mounted upon will be prevented. This is critical in an emergency situation where lights, cameras, or other devices mounted on top of the pop-up telescoping mast system can inadvertently be placed into unguarded electrical wires. Furthermore, since the wiring harness 106 is encased within and protected by the mast sections, a fuse system 116 can be incorporated into the wiring circuit within the protected mast passageways and ameliorate concern that the fuse may prove inoperative due to exposure to the elements over time. A fuse 116, of the type common in the industry, in the protected environment of the enclosed mast sections of the present invention will be free of failure from exposure to the elements and will function as expected to stop a surge of electric current from the wires going into the base of the unit, and therefrom into the vehicle frame. A suitable fuse; system is manufactured by McMaster-Carr Supply Co. located at 200 Aurora Industrial Parkway, Aurora, Ohio 44202, as parts numbers 7085K78 and 7696K31.

In addition to the advantages summarized above, the subject invention provides a lightweight alternative to conventional telescoping mast systems. The component configuration of the telescoping mast system of the invention, namely the two mast sections, mounting plate, and dual ball drive actuators, is significantly lighter than hydraulic or pneumatic alternatives. This weight reduction not only makes the subject unit easier and more convenient to install, but also reduced the stress imposed upon the vehicle roof to which the unit is attached.

Figure 8:
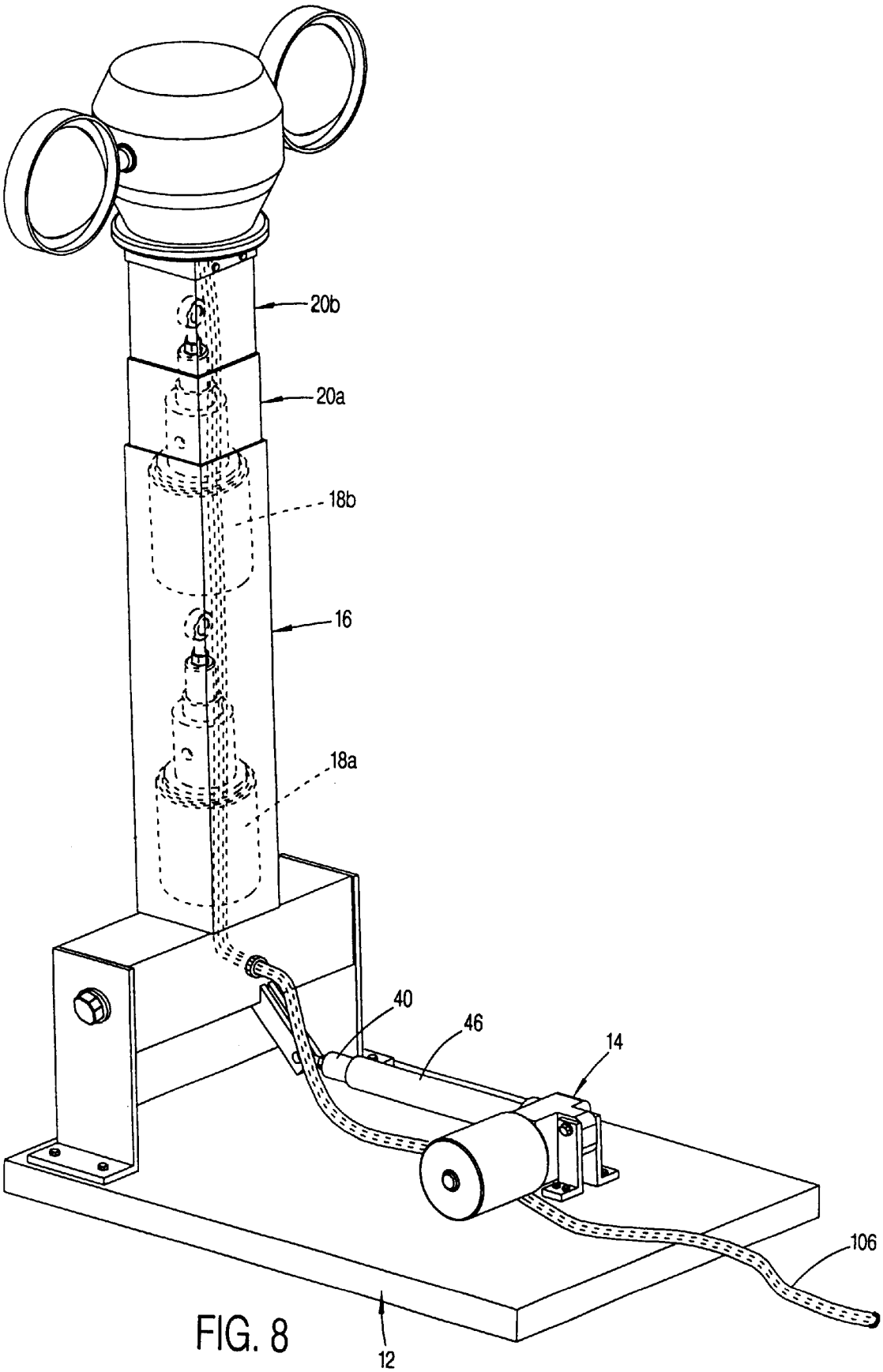
FIG. 8 is a perspective view, shown partially in phantom, of an alternative three stage telescoping mast configured according to the present invention.
Figure 9:
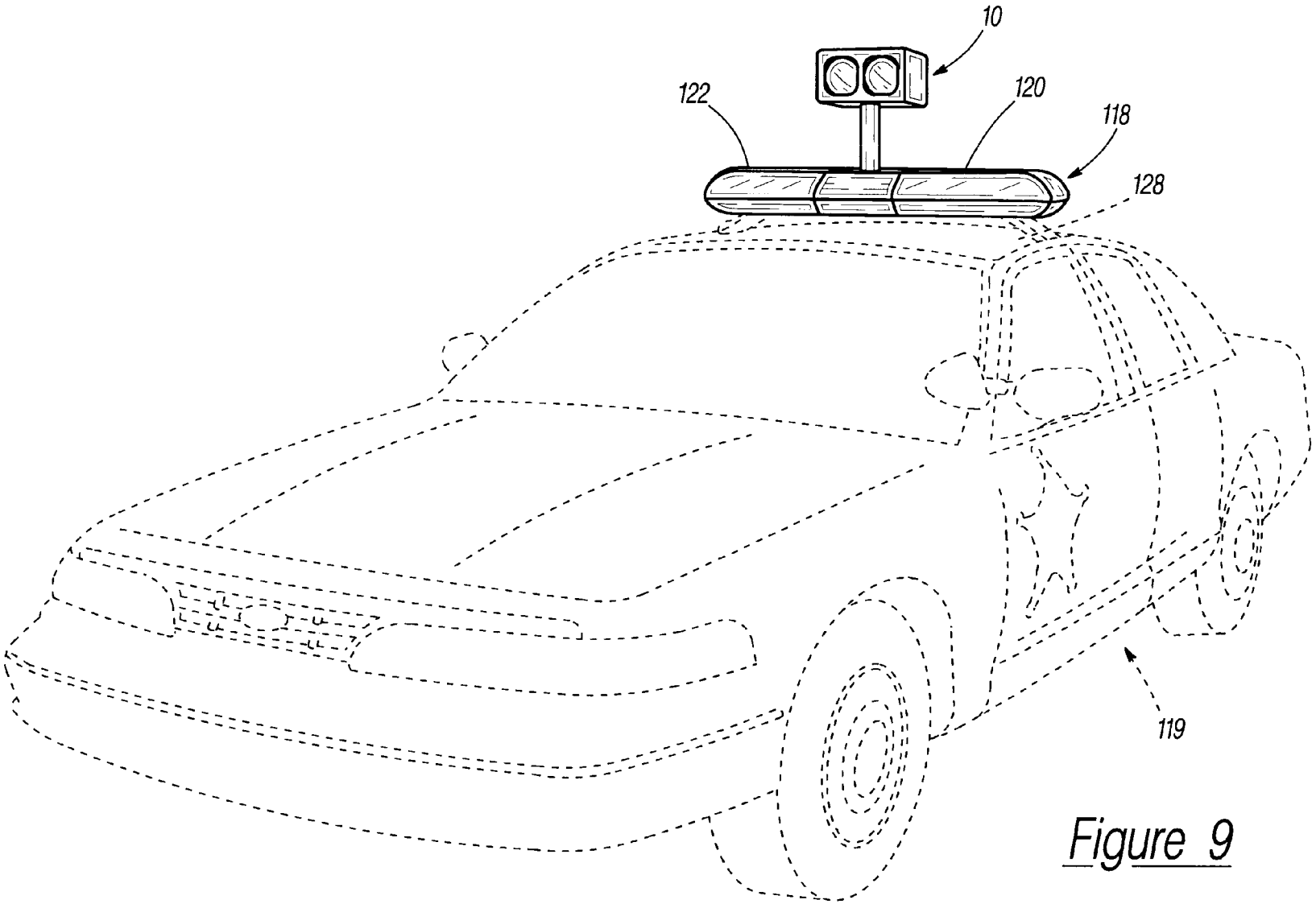
FIG. 9 is a front perspective view of an alternative embodiment of the subject mast assembly, mounted to the rooftop of a police vehicle shown in phantum.

An alternative three section telescoping mast assembly is depicted in FIG. 8. Shown in phantom are two ball actuator drives 18-*a*, 18-*b* used to extend and retract respective extendible mast sections 20-*a*, 20-*b*. The addition of a mast section 20-*b* allows for extended reach while still affording the same reliability and adjustability advantages of the two mast section described previously. It will be appreciated that, as with the preferred embodiment, the three section alternative embodiment employs a ball drive actuator for each of the mast sections. A high load actuator 14 is mounted on the base plate 12 as described previously and pivots the base mast section 16 and extendible mast sections 20-*a* and 20-*b* between a horizontal "down" position and a vertical "up" position. The motors and the wiring harnesses are encased within the mast sections and are protected from the elements and from contact with obstructions. Referring inclusively to FIGS. 9–15, a representative police vehicle 119 is shown in phantum having an elongate, generally linear, horizontal light bar 118 mounted to extend transversely across the vehicle rooftop. The light bar 118 comprises a right segment 120, a left segment 122 and a mid-segment 126 having a slot 125 extending therethrough. The mid-segment 126 mounts to a vehicle roof 128 by conventional fastener means (not shown). Light, bars are standard equipment for police and emergency equipment and typically comprise a, basic halogen bar equipped with optional rotators, flashing lights, oscillators, takedown lights, alley lights, strobe lights, sirens, and/or a speaker unit. By way of example, representative light bars are MX 7000 and Excalibur Code 3 light bars sold by 21$^{st}$ Century Police Supply, located at 251 South 3$^{rd}$ Street, Columbus, Ohio 43215-5132, incorporated herein by reference. A light bar of a police or emergency vehicle is generally controlled from the interior of the vehicle by the driver or passenger. Appropriate control circuitry and wiring is directed from the vehicle passenger compartment to the rooftop with which to power (typically via the vehicle 12 volt battery system) and operationally control the light bar and its accessory options such as strobe lights, sirens, speakers, and flashers.

Figure 10:
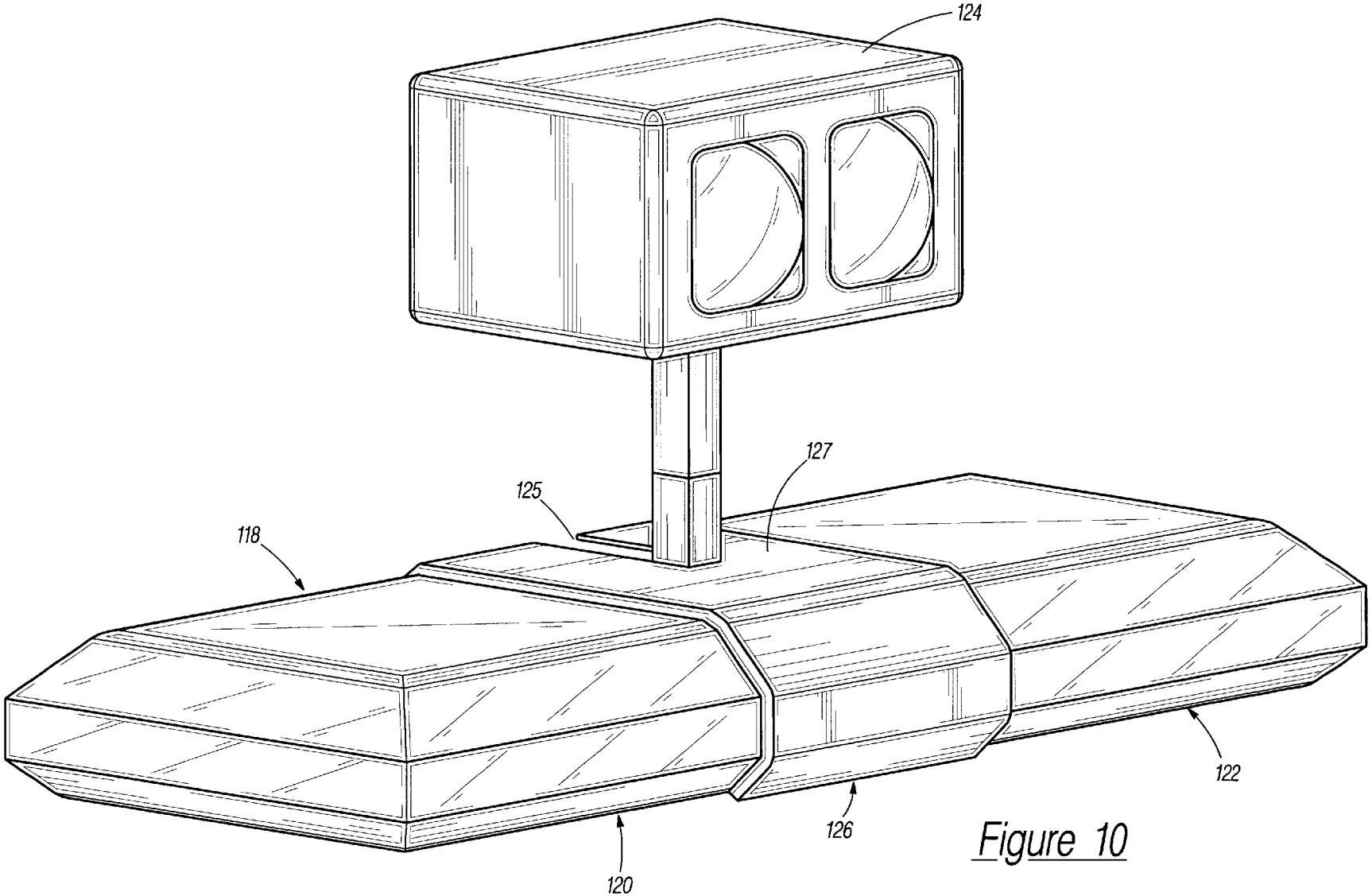
FIG. 10 is an enlarged front perspective view of the alternative embodiment of the subject mast assembly.
Figure 11:
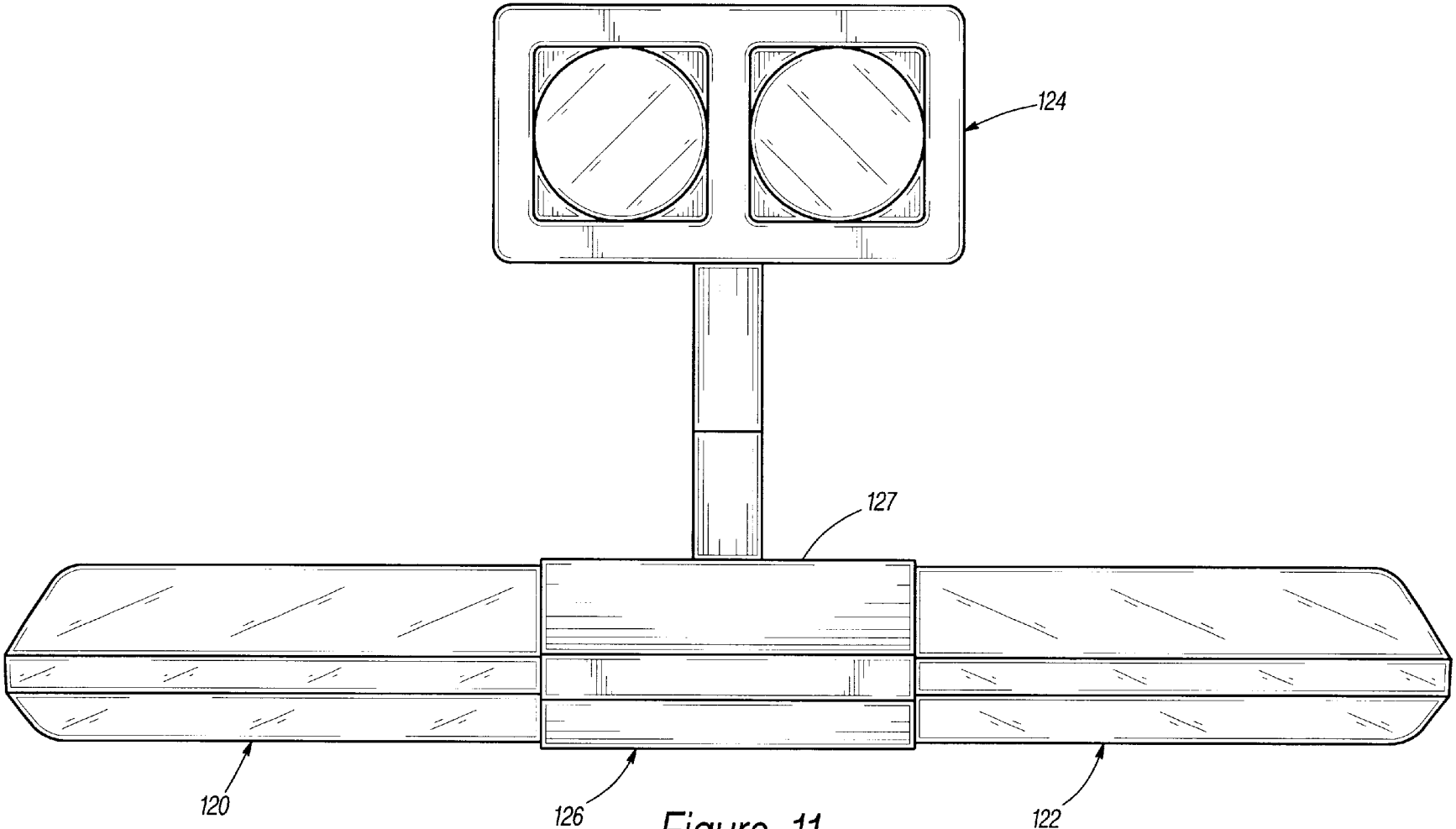
FIG. 11 is a front plan view of the alternative embodiment.
Figure 12:
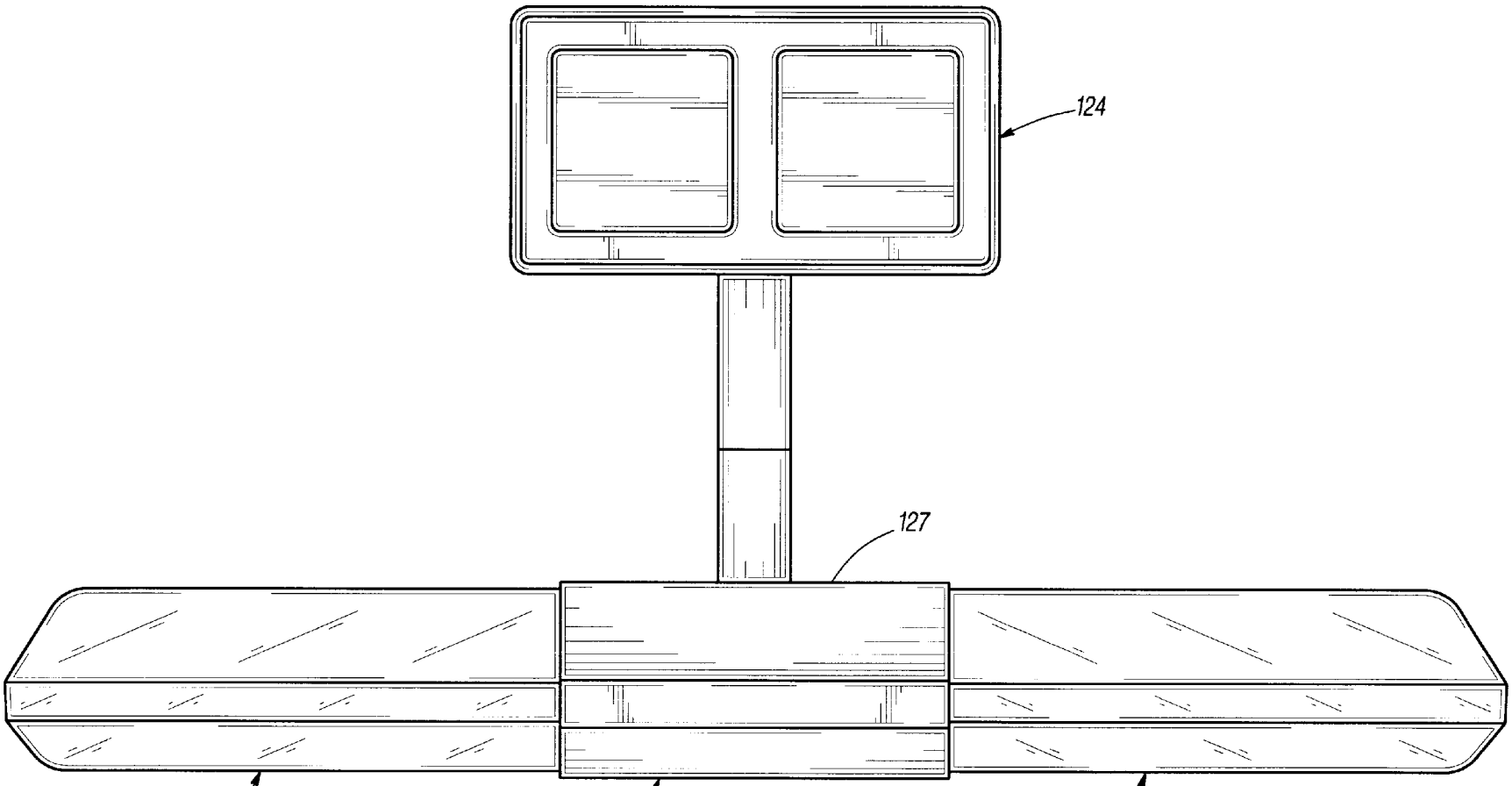
FIG. 12 is a rear plan view of the alternative embodiment.
Figure 13:
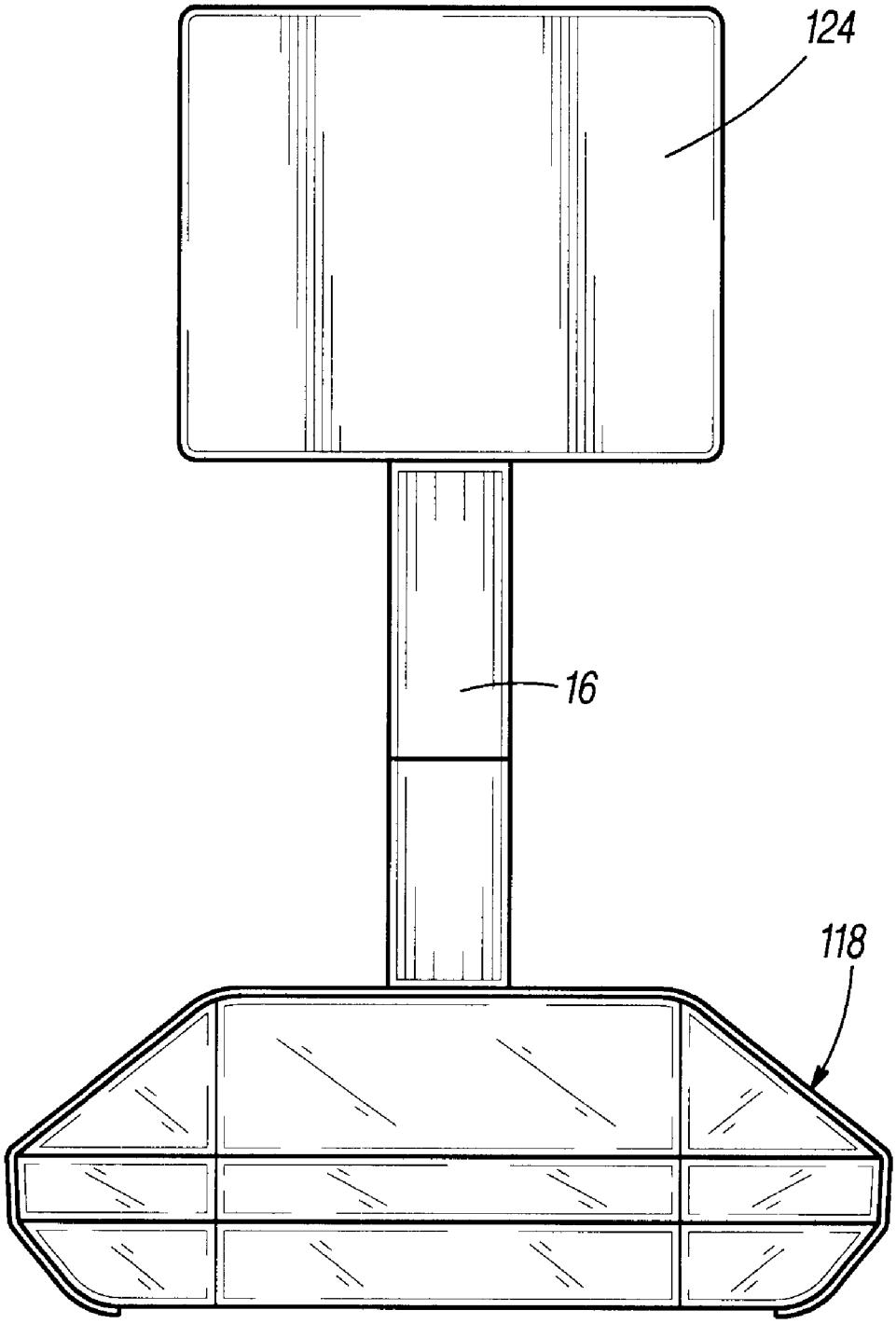
FIG. 13 is a side elevational view of the alternative embodiment.
Figure 14:
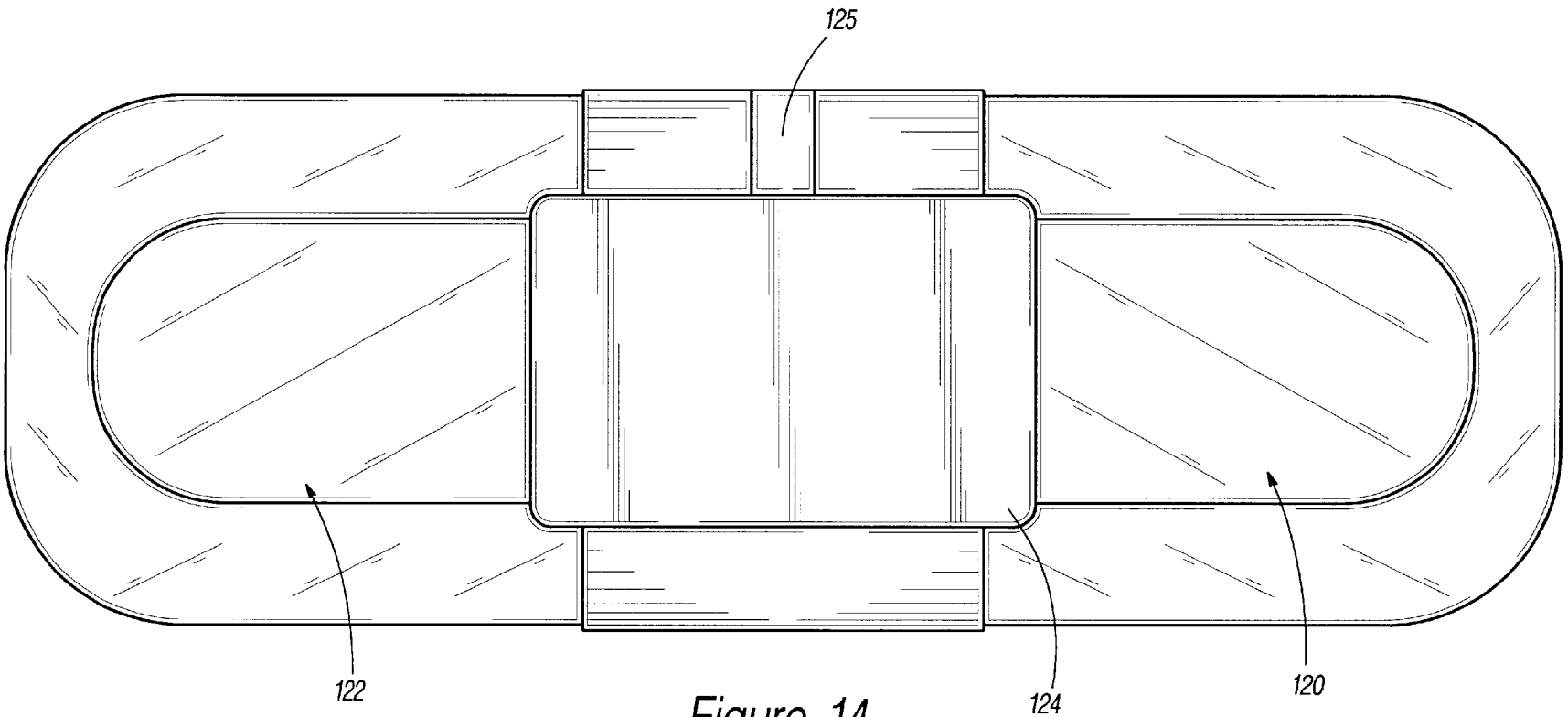
FIG. 14 is a plan view thereof.
Figure 15:
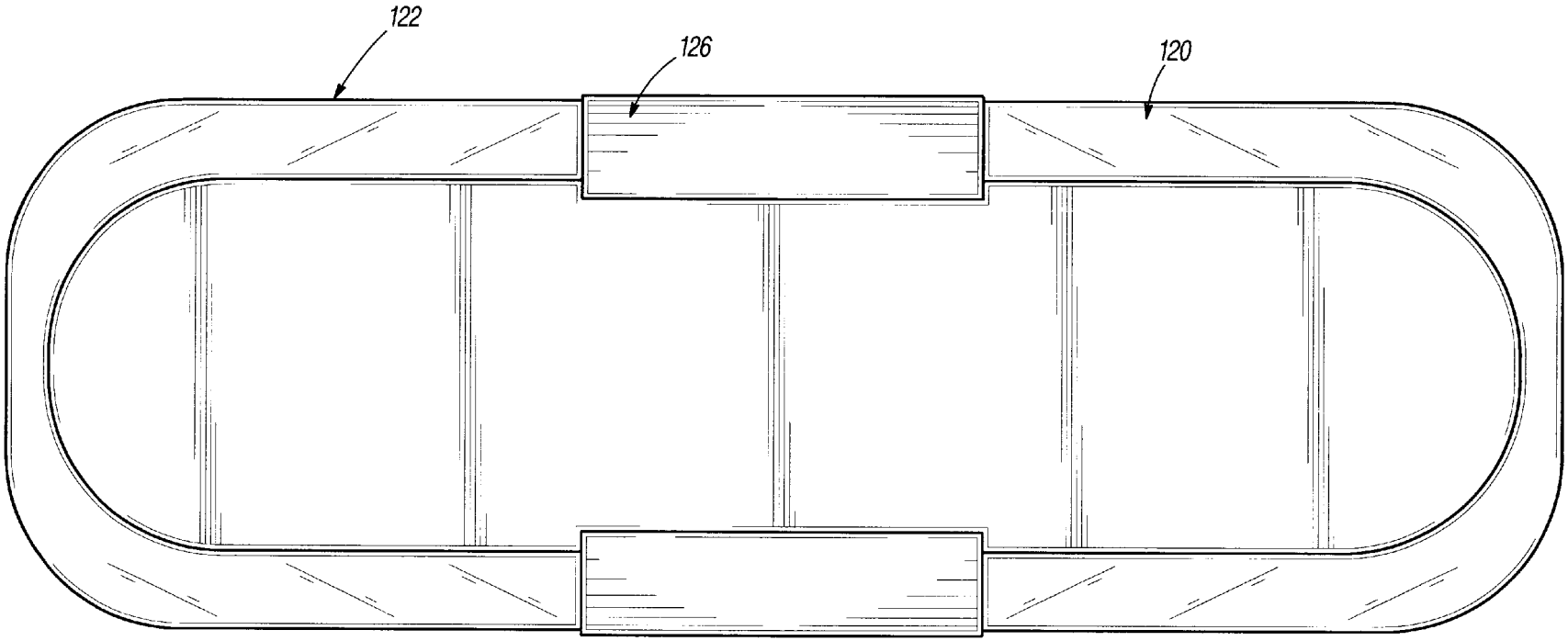
FIG. 15 is a bottom plan view thereof.
Figure 16:
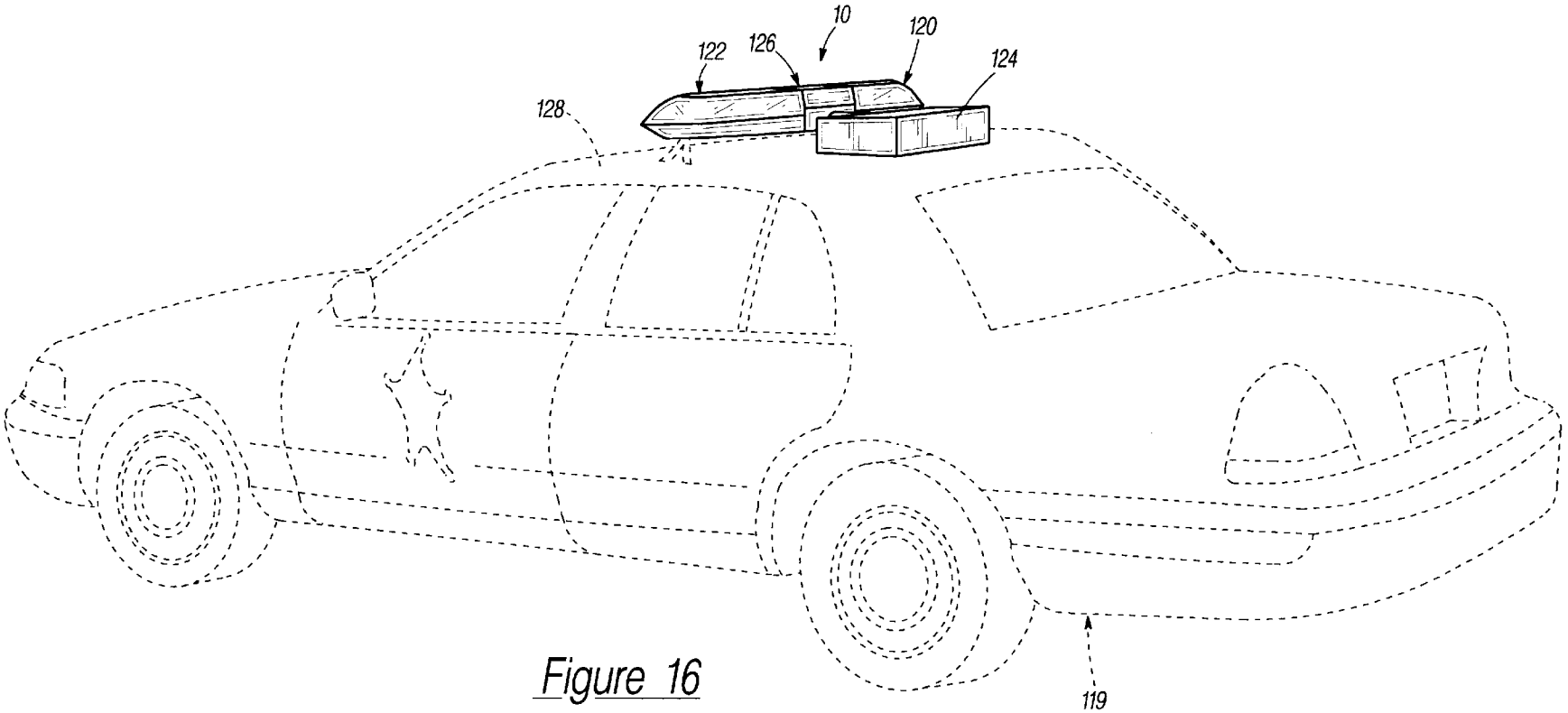
FIG. 16 is a rear perspective view of the alternative embodiment shown in the down position upon the rooftop of a police vehicle illustrated in phantum.
Figure 17:
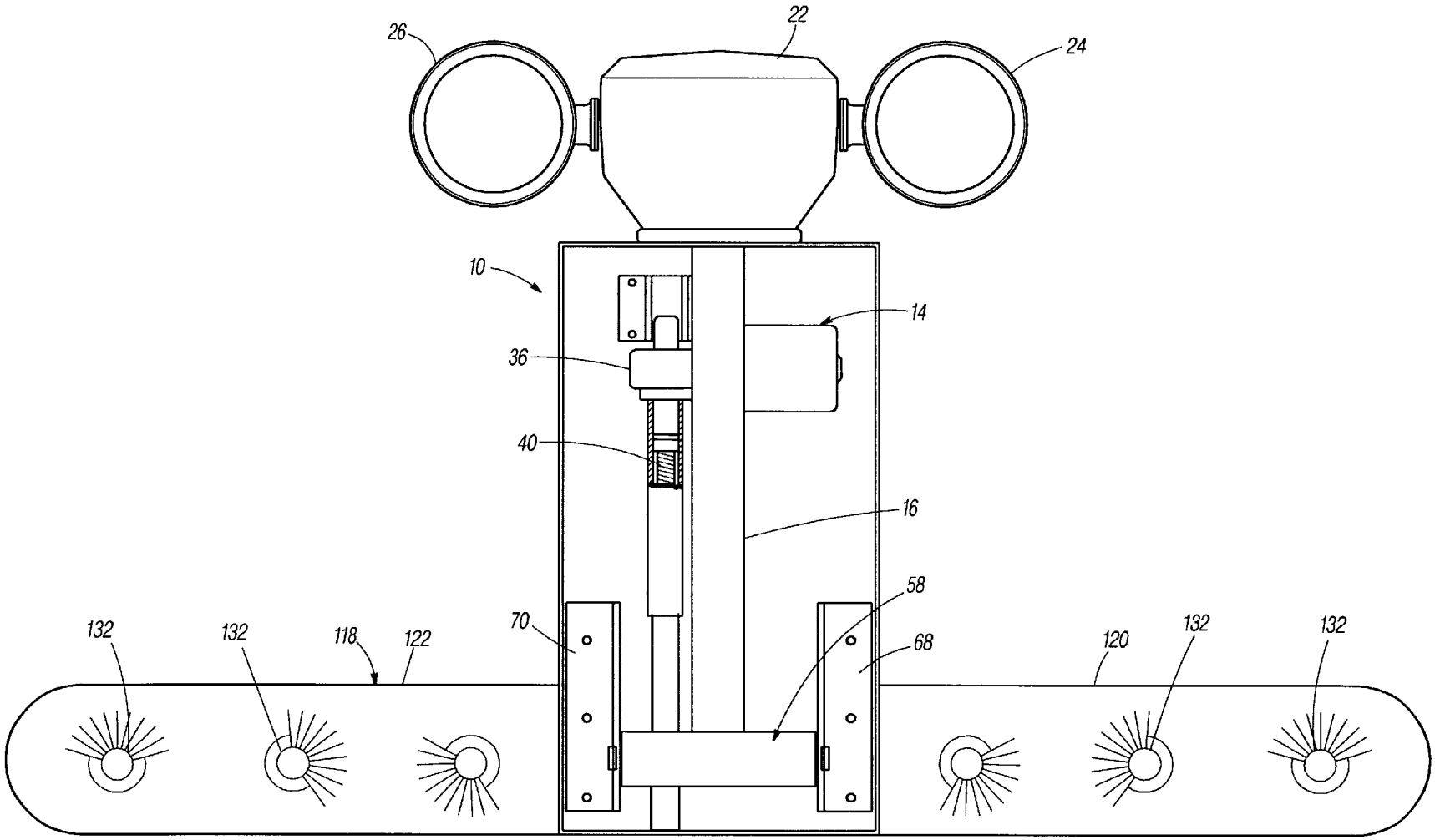
FIG. 17 is a top plan view of the alternative embodiment of the invention shown in the down position with a center section cover removed to illustrate the mast assembly.

With specific reference to FIGS. 10 and 17, an alternative embodiment of the subject invention is shown incorporating the telescoping mast assembly 10 described previously within a light bar 118. The mast assembly 10 is configured to comprise a base mast section 16 affixed to transverse support arm 58 that is rotatably coupled to support brackets 68, 70. Brackets 68, 70 are fixedly secured to the roof 128 of vehicle 119 by suitable hardware (not shown). It will be appreciated that the mast assembly 10 is substantially in line with the light bar 118, positioned midway between light bar segments 20, 22. The pivot axis of the mast assembly, represented by support arm 58, is likewise in-line with the light bar 118.

The base mast section 16 is moved within cover slot 125 between a down, or horizontal, position into an upright, or vertical, position by a ball drive actuator. The actuator comprises a motor 14, housed in housing 36, which drives a ball drive screw 40 in forward and rearward directions. The forward end of screw 40 is coupled to rotate the arm 58 counterclockwise when moving forwardly to elevate the mast section 16 into its upright vertical orientation. In the reverse direction, the screw 40 rotates the arm 58 clockwise and thereby actuates a pivotal movement of the mast section 16 from the vertical orientation into the down position upon the vehicle roof 128. The mast section 16 can be a single section or an assembly of sequentially extending and retracting telescoping sections as described previously. Positioned at the top of the mast 16, or an uppermost telescoping section, is a light motor 22 which rotates right and left light assemblies 24, 26. The motor 22 and lights 24, 26 are electrically powered by cabling extending within the mast 16 to the base support structure. A housing 124 is provided in the alternative embodiment with which to house the lights 24, 26 as shown in FIG. 10. The mid section 126 of the light bar 118 where the mast assembly 100 is situated provides a cover 127 adapted to conform with the external geometry of covers of light bar segments 120, 122.

In the down position, the mast assembly lies flat against the roof of the vehicle, below the upper boundary of the light bar. Thus, the mast assembly does not protrude above the light bar and an overall low profile is maintained. It will be noted that vehicle rooftop space utilization is optimized by placement of the mast assembly in-line with the light bar. For vehicles with a smaller roof area, the subject invention provides the means for accommodating both a telescoping mast assembly and a light bar when independent units may not fit upon the roof because of space constraints.

In the alternative embodiment, control and power wiring with which to power and activate the light bar 118 and the telescoping mast 10 may be shared or wired separately. The preferred embodiment routes control circuitry from the light bar 118 to the interior compartment of vehicle 119 and a power conduit is provided to power the light bar 118 and mast assembly 10 off of the 12 volt vehicle power system.

As best seen from FIG. 17, the left and right segments 120, 122, of light bar 118 includes a series of lights 130, 132 respectively. Such lights may include a strobe light, flood lights, or a combination thereof providing for various illumination effects. The mast assembly 10 is configured to provide sufficient strength with which to withstand wind stress induced upon the mast 10 when the vehicle is in motion. The ball actuating drive 14, 40, exerts 500 pounds of force, which exceeds the mean weight of 50 pounds for the mast 16 and light assembly 22, 24, 26. The excess force is sufficient to counteract the wind sheer forces exerted upon the mast assembly when the vehicle is in motion at a speed not to exceed 80 miles per hour with a one square foot of "sail" area at the top of mast. The lights and/or other electrical components mounted to the mast top, accordingly, should be in a package not to exceed a one square foot "sail" area in order to allow movement of the vehicle at 80 miles per hour with the mast "up". Thus, the mast 16 is strong enough to be maintained in a vertical or upright condition during vehicle movement, whereby allowing for elevated use of lights 24, 26.

Figure 18:
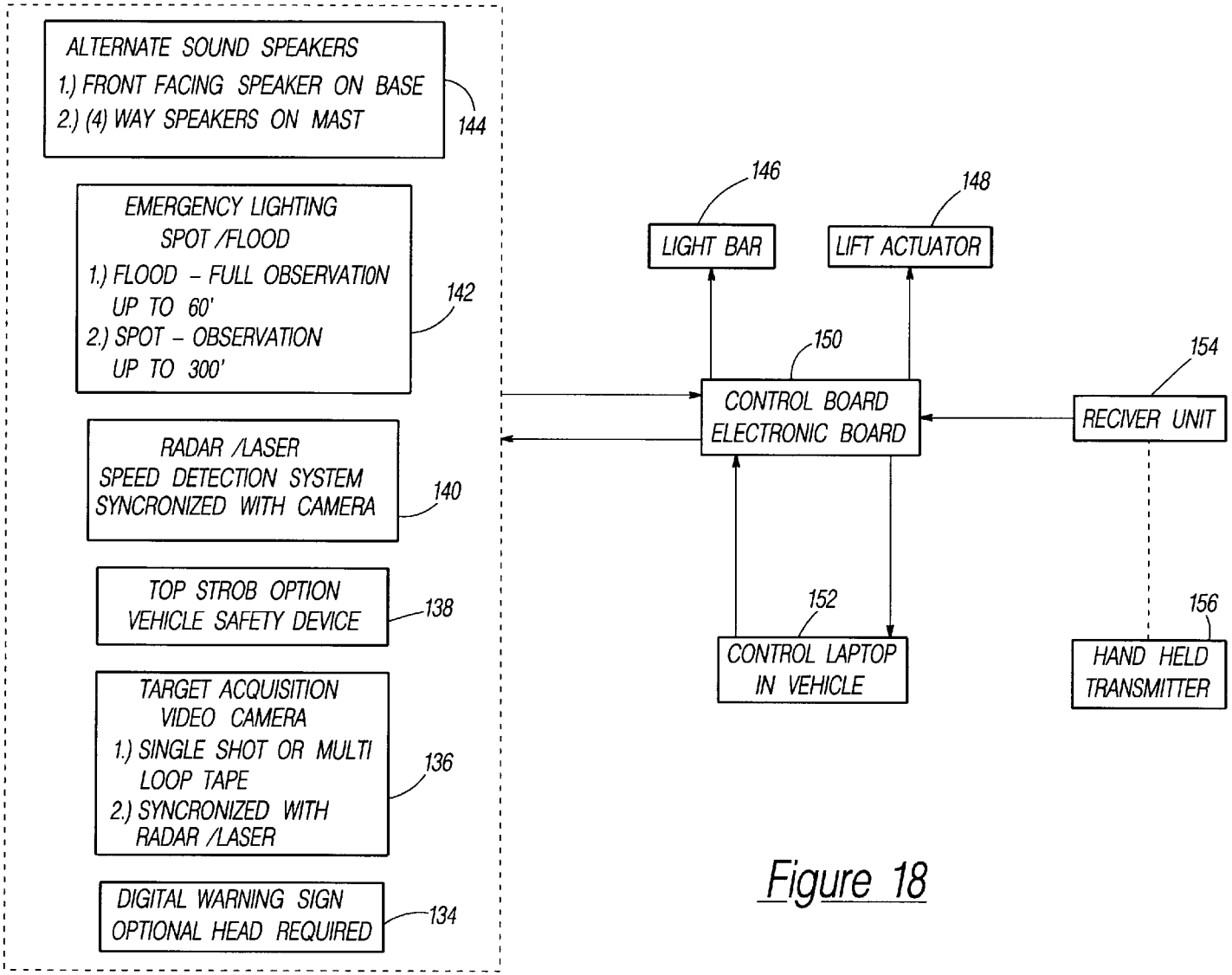
FIG. 18 is a diagrammatic view of representative optional equipment mountable to the alternative embodiment mast assembly.

The mast and light bar assembly depicted in FIG. 17 is preferably part of a security system. The mast assembly 10, in such a security system, can be used to deploy not only flood lights at an elevated level above the rooftop of a police or emergency vehicle, but can also elevate other types of devices which would benefit from a height advantage. By way of example, without an intent to limit the invention to the examples provided, optional devices as indicated in the diagram of FIG. 18 may collectively or alternatively mounted to the upper extremity of the mast assembly 10 of FIG. 17. Such optional devices may include, among others, a digitally activated warning sign 134. In certain situations, it would be useful to equip a police or emergency vehicle with the means to convey via a warning sign certain information. For example, such a sign may advise motorists to use caution at the scene of an accident.

Another optional device deriving functional benefit from a height advantage is a video surveillance camera 136. Available cameras are single shot cameras or multi-loop video tape cameras. Such devices are often synchronized with radar/laser detection devices 140. A model Pro-1000ODS Kustom Signals Radar detector and a Galls StrretImage Video System sold by Galls, 2680 Palumbo Drive, Lexington, Ky. 40509-1000 are representative of such devices.

As an alternative or addition to the lights 24, 26, a strobe light 140 and/or emergency spot or flood lights 142 may be mounted to the mast 40. A 21$^{st}$ Century Vista Strobe manufactured by Federal Signal and a CODE 3 Remote-Controlled Spotlight sold by 21$^{st}$ Century Police Supply of 251 South 3$^{rd}$ Street, Columbus, Ohio 53215-5132 (hereinafter "Century") are exemplary of an available strobe light and spot light. Utilization of such a strobe and spotlight would benefit from a position of elevation above the roof of a police vehicle.

A further optional device which may be mounted to the mast 40 to benefit from the height advantage achieved thereby is a siren such as a UNITRO TM4 Touchmaster Siren; and a speaker device 144 such as a BP 100 speaker which are likewise sold by Century. Placing such devices at positions of elevation by the mast 40 above the roof of the vehicle would effectively enhance the range of each, providing the police and emergency vehicle with greater coverage than a rooftop or dashboard mounted device.

The optional devices 134-144, as diagrammed in FIG. 18, and other devices which will be readily apparent to those skilled in the art, are preferably electrically coupled to a microprocessor based control board 158 situated within the vehicle passenger compartment. The control board 158 controls the light bar 146 and activates the lift 148 under driver or passenger control via a personal computer 152 or other control hardware within the vehicle. The control board 158 monitors the status of the light bar, lift mast, and the devices carried thereby, and inputs status data to the computer 152 on a continuous basis.

Figure 19:
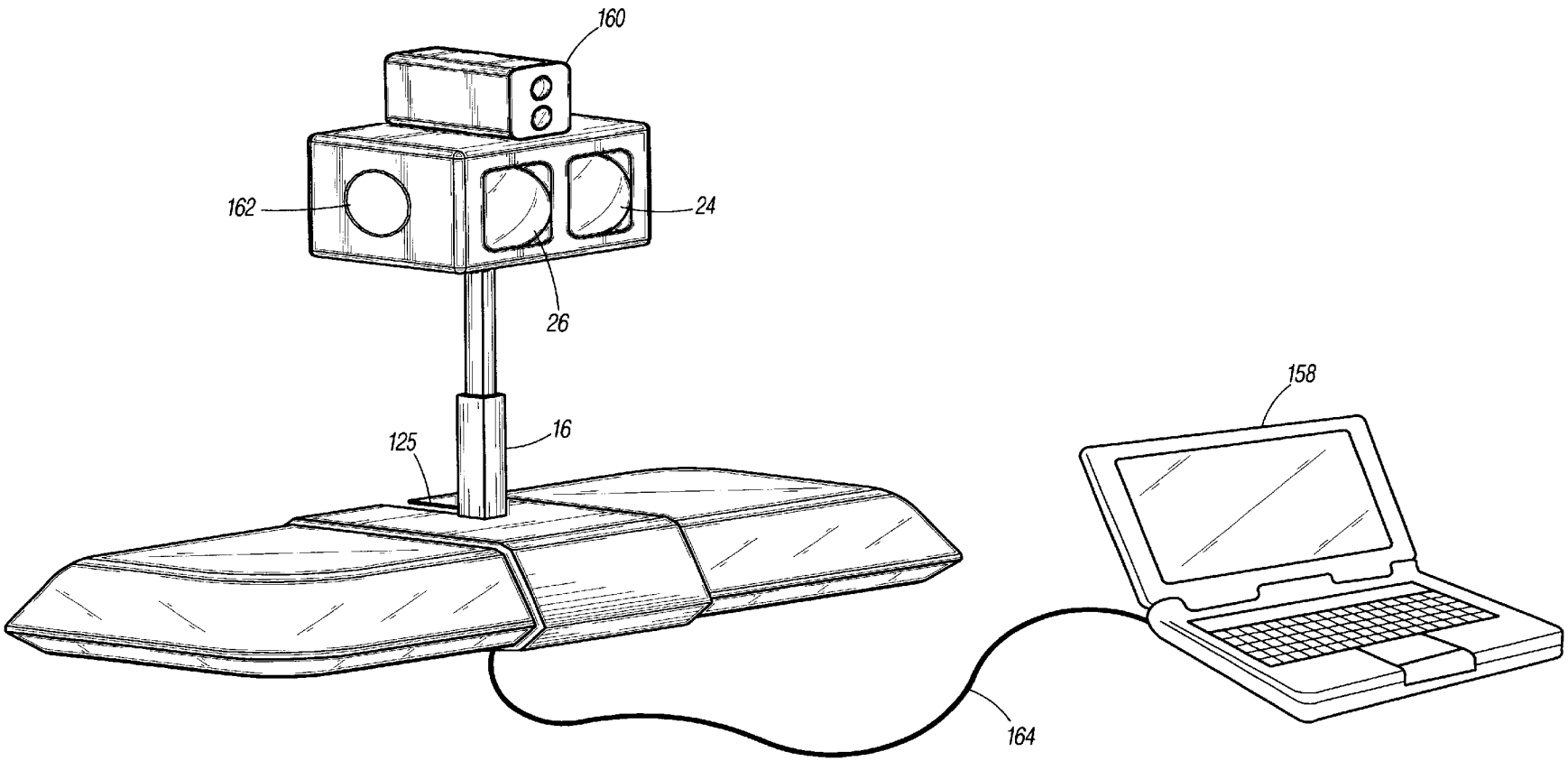
FIG. 19 is a front perspective view of a third embodiment of the subject invention showing optional devices mounted to the mast assembly.

A receiver 154 and transmitter 156 pair, available in the industry, may also be employed to provide the vehicle operator with the means to control the mast and light bar assembly from locations away from the vehicle if necessary or desirable. FIG. 19 illustrates a third embodiment of the invention in which alternative optional devices are mounted to a telescoping mast assembly 16. The mast assembly 16 supports at a remote end an electronics package including lights 24, 26; a radar/laser detector 160 and speakers 162 (one of which being shown). The light bar, mast assembly 16, and associate devices 24,26,160, and 162 are controlled by a personal computers 58 located preferably within the passenger compartment of the vehicle (not shown). The computer 158 is connected electrically to the devices by a lead 164 extending to the light bar, the mast assembly 16, and up the interior axial passageway of the telescoping mast sections to the devices at the remote end. Accordingly, the computer 158, of a type commercially available, through conventional commercially available software can operate to control the function of the light bar, radar/laser detection equipment, mast assembly, etc. By moving the devices 160, 162 from the interior of the passenger compartment to the mast end, improvement in the functional performance of the devices is achieved and the passenger compartment is cleared.

From the foregoing, it will be appreciated that the objectives of the invention as embodied in the alternative embodiment have been achieved. A light bar is provided having an integrated telescoping mast assembly incorporated therein. The mast includes a horizontal pivot axis which extends substantially in line with the light bar. The mast pivots between a storage position substantially flat against the rooftop of the vehicle and an upright position perpendicular to the roof. Locating the mast assembly in line with the light bar maximizes efficient utilization of the rooftop surface area. Were the mast assembly to be located apart from the light bar as a separate unit, its space requirements would preclude the mounting of both the light bar and mast on the rooftops of smaller vehicles.

The operation of the mast, light bar, and associate equipment and devices carried by the mast may be operated by controls operable from the passenger compartment. The mast is of sufficient strength to enable its extension and operation during vehicular movement, whereby facilitating the usage of the devices carried by the mast during such time. The mast can accept and carry at its remote end a myriad of safety devices such as, but not limited to, a strobe light; a flood light; video equipment; audio equipment; radar/laser systems; a warning sign, etc. Wiring for such equipment and the light bar may be shared. A safety system, accordingly, is taught herein comprising a horizontal light bar; a mast assembly integrated in-line with the light bar and pivoting between a storage position against the rooftop and an extended vertical position; one or more safety devices or detection components mounted to the remote end of the mast assembly and elevated thereby above the roof of the vehicle; and associated controls located within the vehicle whereby the mast assembly, light bar, and safety/detection devices carried by the mast may be operated and controlled. The controlling device is preferably a microprocessor based computer located proximate the driver or a passenger of the vehicle so as to inform the operator of the status of the mast assembly, light bar, and remote devices in real time. Software enabling the computer to perform such functions is commercially available.

The advantages of the present safety/detection system will be readily apparent. Moving the radar/laser, siren, spotlighting; audio system, video system from the interior dashboard of the vehicle to the remote end of the mast assembly simplifies the interior of the passenger compartment for the vehicle driver and passengers. An uncluttered interior makes the vehicle safer to operate and more comfortable to the driver and passengers. Moreover, the operator (typically the driver) of such devices is capable of controlling the remote devices via personal computer commands from the vehicle passenger compartment. Relocation of the active devices to the remote end of the mast assembly places such devices at a height advantage and thereby enhances their performance. In addition, a digital sign can be included in the package of devices. The sign, activated from the computer within the passenger compartment, can, from an elevated position atop the mast assembly, communicate information and warnings to the surrounding environ. The elevated vantage position of the sign is a significant advantage when the vehicle is located over the rise of a hill, or obscured by objects surrounding the vehicle.

The alternative embodiment described previously comprises further the method of converting a conventional light bar assembly into a safety light bar system in which a myriad of security and detection devices may singularly or in combination be integrated into the light bar. The method of conversion comprises the steps providing a elongate mast assembly positioned in-line with the light bar assembly, the mast pivoting between a storage position adjacent the vehicle rooftop and an extended vertical position;

modifying a remote end of the mast assembly to support at least one of a plurality of security devices; affixing at least one of a plurality of security devices to the remote end of the mast assembly; and providing control means within a passenger compartment of the vehicle for controlling the operation of the light bar assembly, the mast assembly, and the one security device. In the preferred embodiment, optional devices which can attach to the remote end of the mast assembly include, but are not limited to, radar/laser speed detection devices; auxiliary lighting; audio equipment; video equipment; and digitally controlled signage for communication information from the elevated position atop the mast assembly. Moreover, in the preferred embodiment, the method of conversion includes powering and controlling the light bar, the mast assembly, and the remote security devices with common power and control wiring. The power line is preferably routed from the vehicle 12 volt system and the control lines are routed from the internal passenger compartment computer.

While the above describes a preferred and an alternative embodiment of the subject invention, the invention is not intended to be so restricted. Other embodiments, which will be apparent to those skilled in the art and which utilize the teachings herein set forth, are :intended to be within the scope and spirit of the invention.

What is claimed is:

1. An extendible mast and light bar assembly for attachment to a vehicle rooftop, comprising:

a base member;

a base mast section pivotally coupled to the base member and pivoting about a pivot axis along a path between a down position and an up position;

a drive motor assembly mounted to the base member and coupled to alternatively drive the base mast section between said up and down positions; and an elongate light bar fixedly attached to the vehicle roof top and extending substantially in co-linear relationship with the base mast pivot axis and the base mast comprising at least one light emitting device.

2. A light bar assembly for the rooftop of a vehicle, comprising:

at least one elongate light bar adapted to transversely and fixedly mount across the vehicle rooftop;

an elongate mast assembly positioned adjacent to and having a pivot axis extending substantially in co-linear relationship with the light bar, the mast assembly pivoting between a storage position adjacent to the rooftop and an extended vertical position and including a device-supporting remote end.

3. A light bar assembly according to claim 2, wherein the mast assembly pivot axis is fixedly positioned on the rooftop of the vehicle in said substantially co-linear relationship with the light bar.

4. A light bar assembly according to claim 2, wherein the mast assembly comprises a base mast segment having an axial passageway and a telescoping mast segment reciprocally mounted to travel within the axial passageway of the base mast segment.

5. A light bar assembly according to claim 2, wherein the light source segment and the mast assembly are electrically wired for control from the passenger compartment of the vehicle.

6. A light bar assembly for the rooftop of a vehicle, comprising:

at least one light source segment adapted to transversely mount across the vehicle rooftop;

an elongate mast assembly positioned adjacent to and in-line with the light source segment, the mast assembly pivoting between a storage position adjacent to the rooftop and an extended vertical position and including a device-supporting remote end;

the light source segment and the mast assembly being electrically wired for control from the passenger compartment of the vehicle and further comprising a microprocessor-based personal computer adapted for location within the passenger compartment for controlling operation of the light source segment, the mast assembly, and a device supported by the device-supporting remote end of the mast assembly.

7. A light bar assembly according to claim 2, wherein the device-supporting remote end of the mast assembly supports a speed detection device.

8. A light bar assembly according to claim 2, wherein the device-supporting remote end of the mast assembly supports a light emitting device.

9. A light bar assembly according to claim 2, wherein the device-supporting remote end of the mast assembly supports a video recording device.

10. A light bar assembly according to claim 2, wherein the device-supporting remote end of the mast assembly supports an audio speaker.

11. A light bar assembly according to claim 2, wherein the device-supporting remote end of the mast assembly supports an audio speaker.

12. A safety light bar system for the rooftop of a vehicle, comprising:

an elongate light bar adapted to fixedly and transversely mount across the vehicle rooftop;

an elongate mast assembly having a pivot axis positioned adjacent to the light bar substantially in a co-linear relationship with the light bar and pivoting about the pivot axis between a storage position adjacent to the vehicle rooftop and an extended vertical position and including a device-supporting remote end;

at least one of a plurality of operator-controlled security devices affixed to the device-supporting remote end of the mast assembly and elevated a distance above the vehicle rooftop by the device-supporting remote end of the mast assembly while in the vertical position.

13. A safety light bar system as set forth in claim 12, further comprising control means within a passenger compartment of the vehicle for controlling the operation of the security devices.

14. A safety light bar system as set forth in claim 12, wherein the mast assembly is interposed between opposite ends of the light source segment.

15. A safety light bar system as set forth in claim 12, wherein the plurality of security devices includes a speed detection device.

16. A safety light bar system as set forth in claim 12, wherein the plurality of security devices includes a video recording device.

17. A safety light bar system as set forth in claim 16, wherein the plurality of security devices includes an audio speaker.

18. A safety light bar system as set forth in claim 17, wherein the plurality of security devices includes a programmable information sign.

19. A safety light bar system as set forth in claim 13, wherein the plurality of security devices includes auxiliary light means.

20. A safety light bar system for the rooftop of a vehicle, comprising:

an elongate light source segment adapted to transversely mount across the vehicle rooftop;

an elongate light bar mast assembly positioned adjacent to and in-line with the light source segment, the mast assembly having a pivot axis substantially in-line with the light source segment and pivoting about the pivot axis between a storage position adjacent to the vehicle rooftop and an extended vertical position and including a device-supporting remote end;

at least one of a plurality of operator-controlled security devices affixed to the device-supporting remote end of the mast assembly and elevated a distance above the vehicle rooftop by the device-supporting remote end of the mast assembly while in the vertical position;

further comprising control means within a passenger compartment of the vehicle for controlling the operation of the security devices, and wherein the control means comprises a microprocessor-based personal computer.

21. A method for converting a light bar assembly into a remote controlled security system, the light bar assembly being of the type adapted for fixed attachment to the rooftop of a vehicle in a transverse direction, the method comprising:

positioning a pivot axis of an elongate mast assembly adjacent to and in substantially co-linear relationship with the light bar assembly, the mast assembly pivoting between a storage position adjacent the vehicle rooftop and an extended vertical position;

modifying a remote end of the mast assembly to support at least one of a plurality of security devices;

affixing at least one of a plurality of security devices to the remote end of the mast assembly;

providing control means within a passenger compartment of the vehicle for controlling the operation of the light bar assembly, the mast assembly, and the one security device.

22. A method for converting a light bar assembly into a remote controlled security system, as set forth in claim 21, including the additional steps of:

tapping into electrical power servicing the light bar assembly and routing electrical power cabling through the mast assembly to the one security device mounted at the remote end of the mast assembly.

* * * * *